US007417651B2

(12) United States Patent
Kawada et al.

(10) Patent No.: US 7,417,651 B2
(45) Date of Patent: Aug. 26, 2008

(54) IMAGE FORMING APPARATUS

(75) Inventors: Kunihiro Kawada, Nagano-ken (JP); Yujiro Nomura, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 390 days.

(21) Appl. No.: 11/320,176

(22) Filed: Dec. 28, 2005

(65) Prior Publication Data

US 2006/0177246 A1 Aug. 10, 2006

(30) Foreign Application Priority Data

Jan. 6, 2005 (JP) ..... 2005-001468
Jan. 11, 2005 (JP) ..... 2005-004296
Jan. 12, 2005 (JP) ..... 2005-005556

(51) Int. Cl.
*B41J 2/385* (2006.01)
*G03G 15/01* (2006.01)

(52) U.S. Cl. ..... 347/116; 399/301

(58) Field of Classification Search ..... 399/301, 399/72, 49; 347/116
See application file for complete search history.

(56) References Cited

U.S. PATENT DOCUMENTS 5,258,154 A 11/1993 Okuyama et al.
2001/0004425 A1* 6/2001 Shinohara et al. ..... 399/301
2002/0001477 A1 1/2002 Nakayasu ..... 399/49
2004/0125391 A1* 7/2004 Zuber
2004/0143042 A1 7/2004 Tanaka et al. ..... 524/100
2004/0208663 A1 10/2004 Sakal et al. ..... 399/49
2004/0223785 A1 11/2004 Abe
2008/0019724 A1* 1/2008 Yamagata ..... 399/72

FOREIGN PATENT DOCUMENTS

JP 55-130565 10/1980
JP 58-059464 4/1983
JP 4-313757 11/1992
JP 09-222764 8/1997
JP 2001-350346 12/2001
JP 2001-350347 12/2001
JP 2001-350348 12/2001
JP 2004-109617 4/2004

* cited by examiner

*Primary Examiner*—Susan S Lee
(74) *Attorney, Agent, or Firm*—Hogan & Hartson LLP

(57) ABSTRACT

A registration mark is a toner image which has a first linear pattern and a second linear pattern, which extend along a main scanning direction, and a two-dimensional pattern. The first linear pattern, the two-dimensional pattern and the second linear pattern are arranged apart from each other in this order along a transporting direction. In short, the linear patterns and extending along the main scanning direction are formed spaced apart from the two-dimensional pattern, one toward the upstream side and the other toward the downstream side, along the transporting direction. This suppresses the edge effect along the transporting direction and realizes accurate detection of the position of each registration mark by a test pattern sensor.

12 Claims, 17 Drawing Sheets

ENLARGED PLAN VIEW OF REGISTRATION MARK

FIG. 3
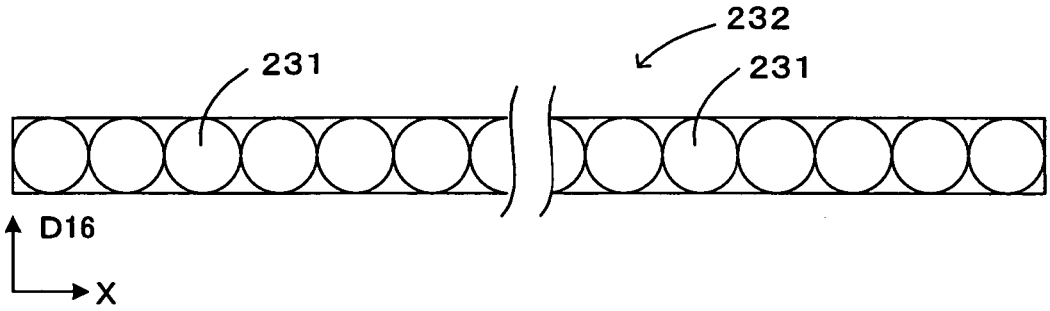
FIG. 4A : LINE LATENT IMAGE (1-DOT LINE)
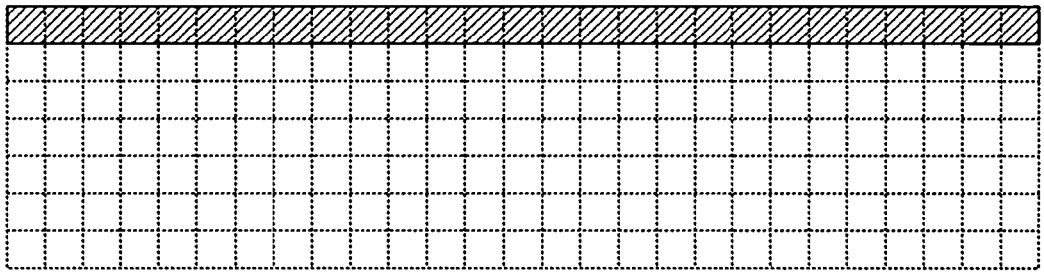
FIG. 4B : LINE LATENT IMAGE (n-DOT LINE)
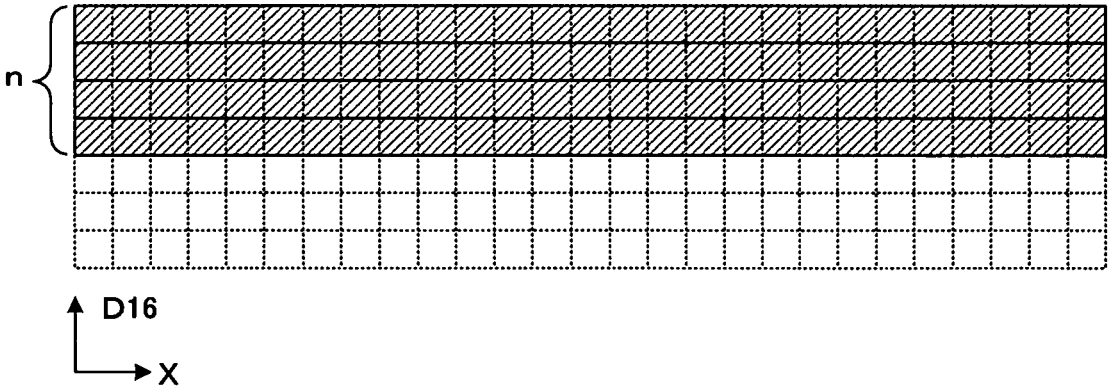

FIG. 5A : ENLARGED PERSPECTIVE VIEW OF SECTION NEAR SENSOR
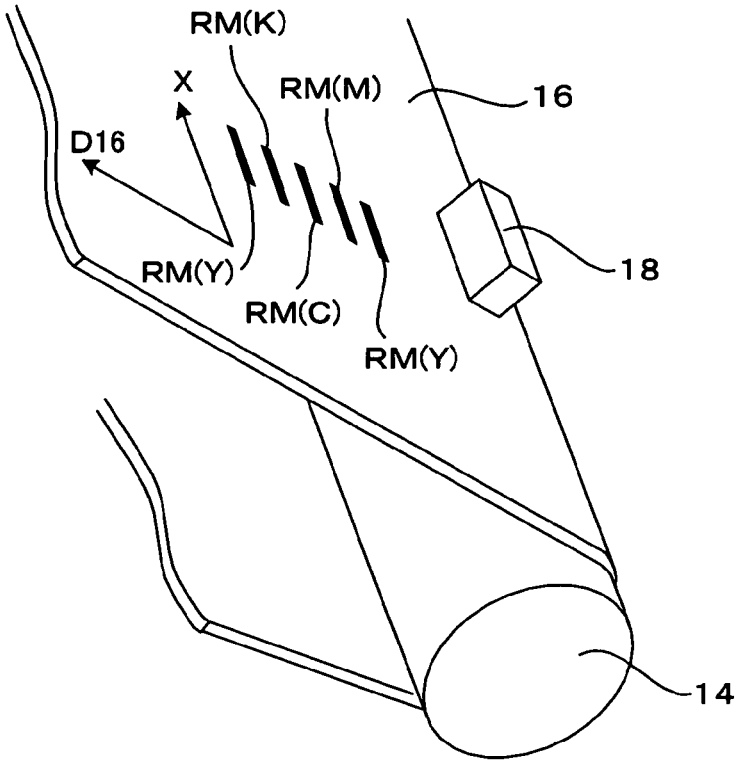
FIG. 5B : ENLARGED PLAN VIEW OF REGISTRATION MARK
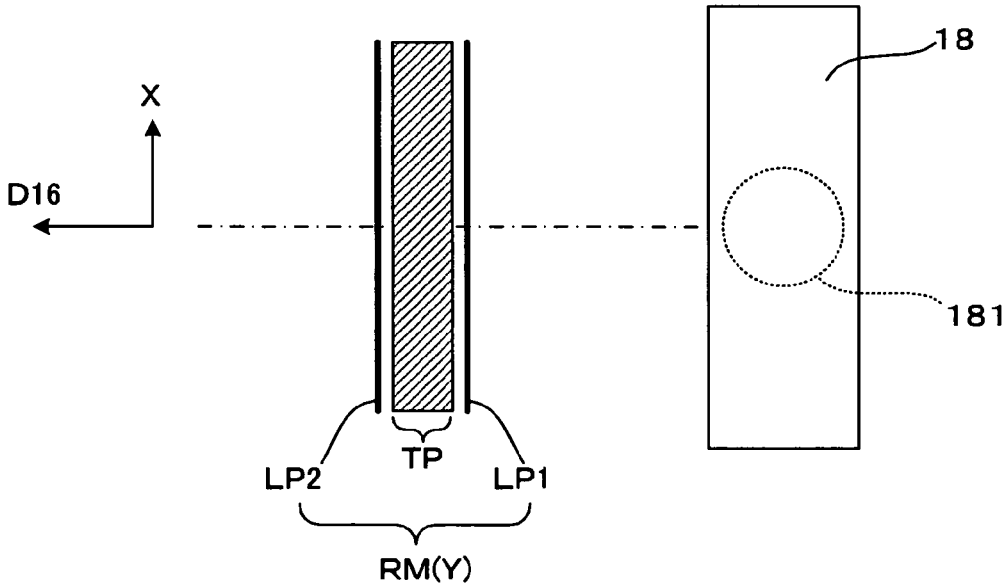

FIG. 11A : ENLARGED PERSPECTIVE VIEW OF SECTION NEAR SENSOR
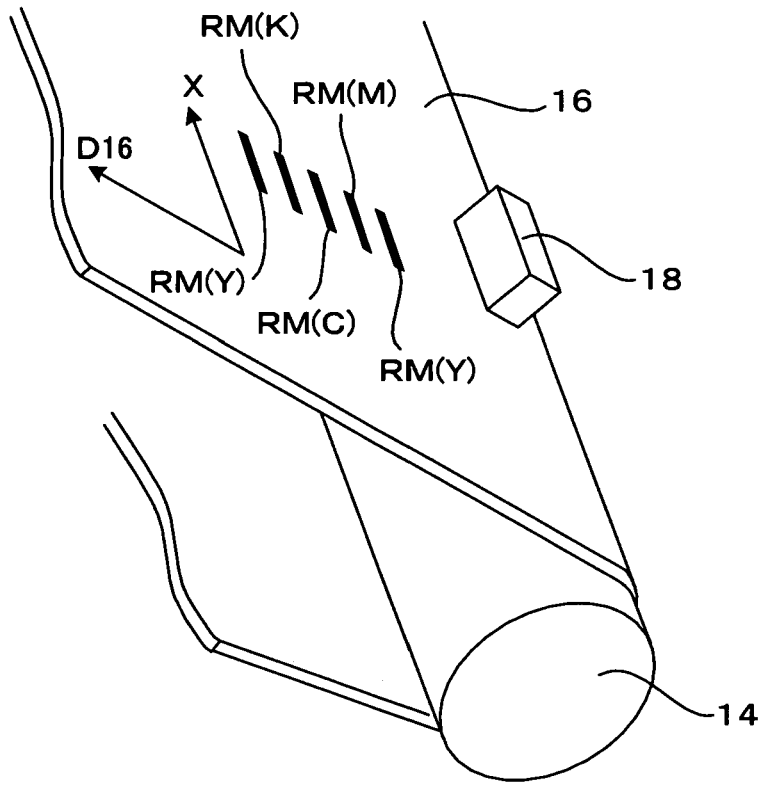
FIG. 11B : ENLARGED PLAN VIEW OF REGISTRATION MARK
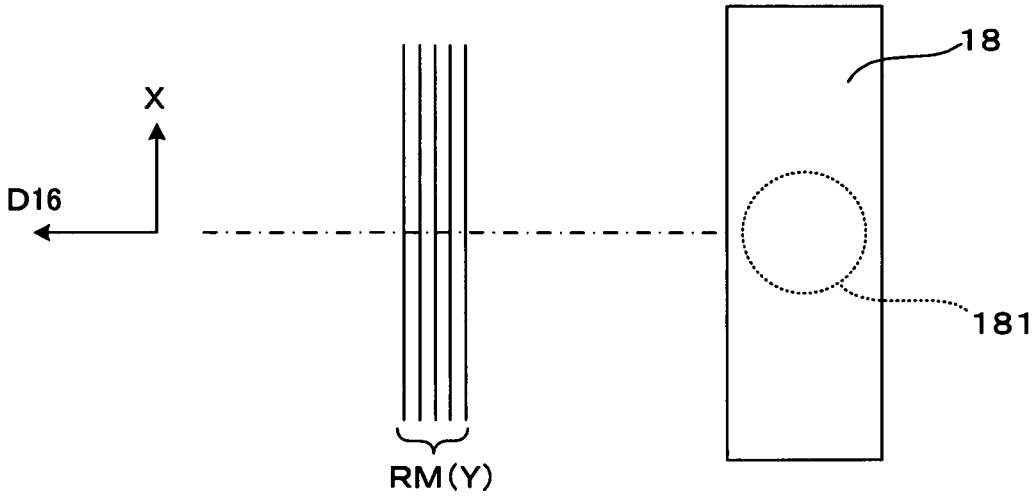

FIG. 12A : SOLID IMAGE
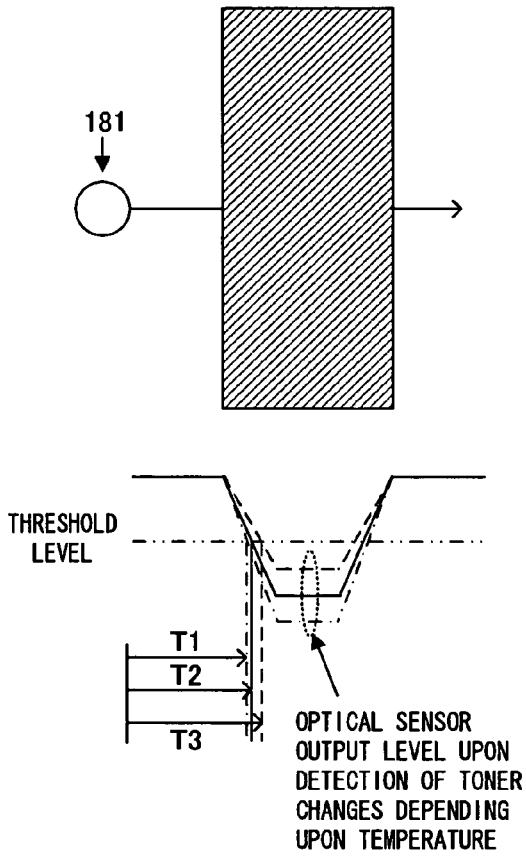
FIG. 12B : HALFTONE IMAGE
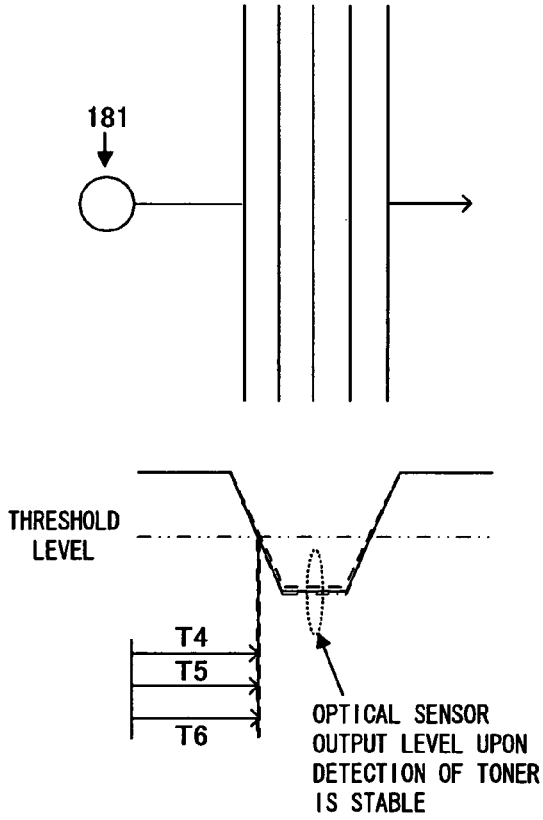

FIG. 13A
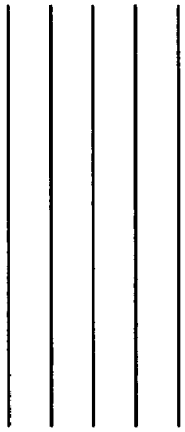
FIG. 13B
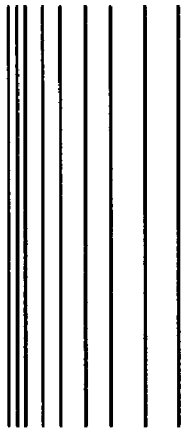
FIG. 13C
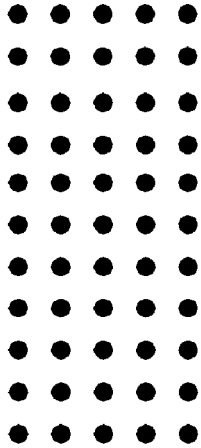
FIG. 13D
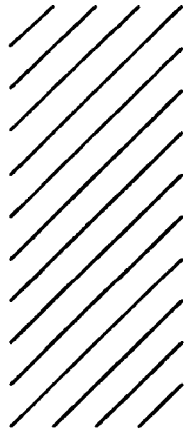
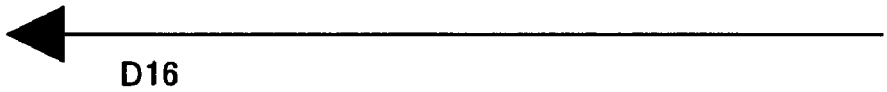
FIG. 13E
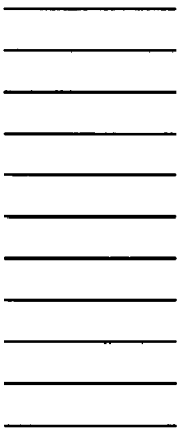
FIG. 13F
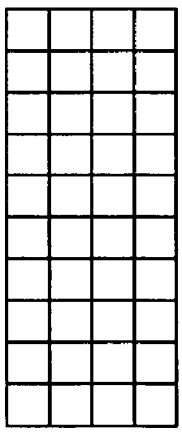
FIG. 13G
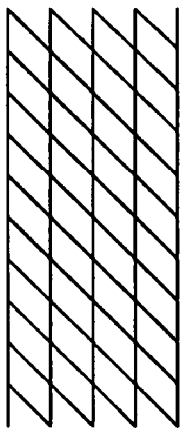
FIG. 13H
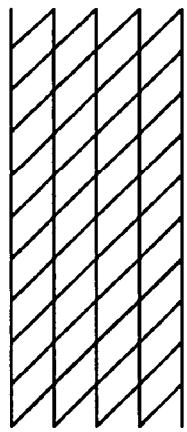
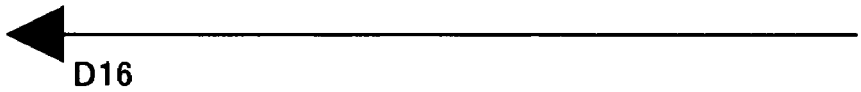

FIG. 18A : ENLARGED PERSPECTIVE VIEW OF SECTION NEAR SENSOR
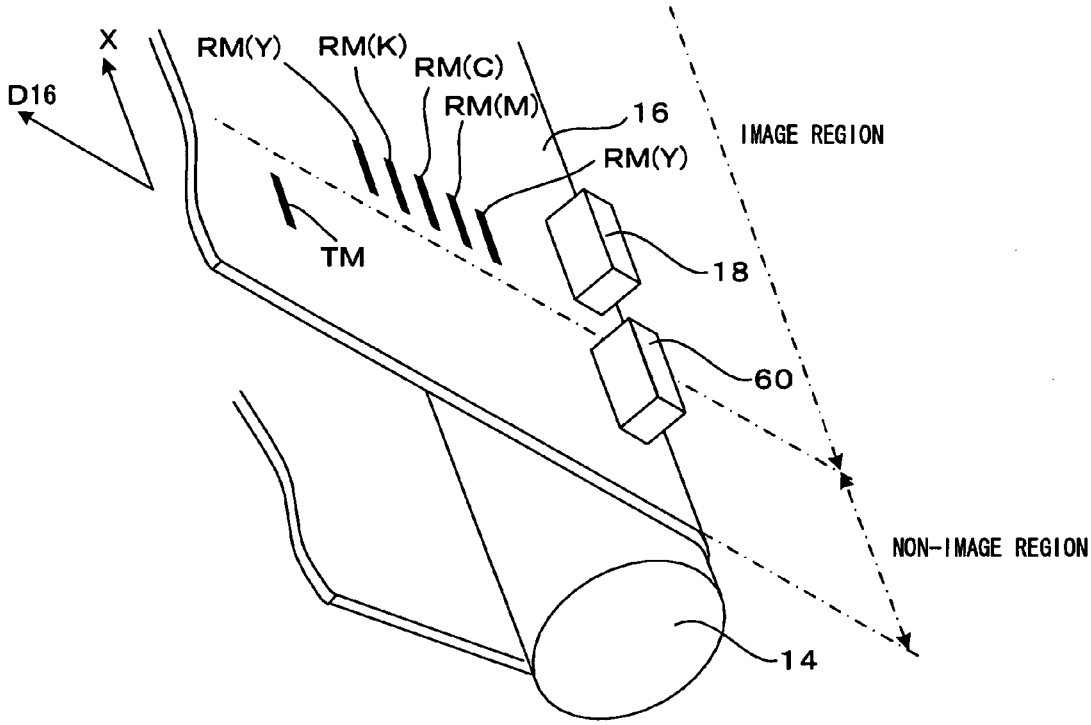
FIG. 18B : ENLARGED PLAN VIEW OF REGISTRATION MARK
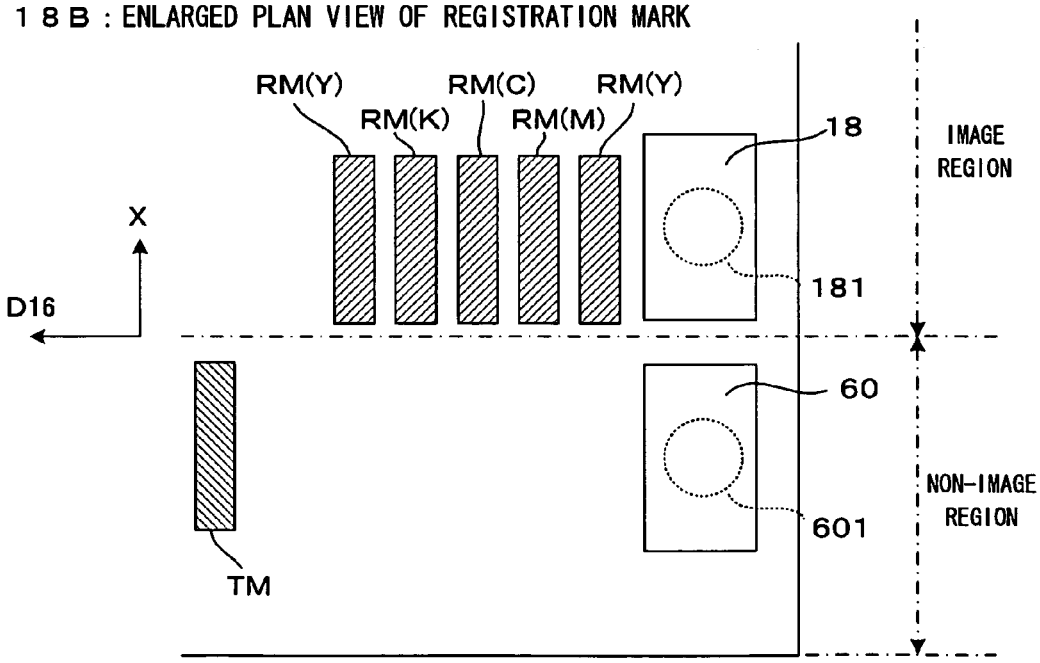

IMAGE FORMING APPARATUS

CROSS REFERENCE TO RELATED APPLICATION

The disclosure of Japanese Patent Applications enumerated below including specification, drawings and claims is incorporated herein by reference in its entirety:

No.2005-001468 filed Jan. 6, 2005;

No.2005-004296 filed Jan. 11, 2005; and

No.2005-005556 filed Jan. 12, 2005.

BACKGROUND OF THE INVENTION

1. Field of the Invention

The present invention relates to an image forming apparatus in which toner images formed by an image former are transferred onto an intermediate transfer medium which moves in a predetermined direction and the toner images are temporarily carried.

2. Description of the Related Art

The apparatus described in JP-A-2004-109617 for example is known as an image forming apparatus of this type. In this image forming apparatus an image forming station, in which a charger, an image writer and a developer are disposed around a latent image carrier such as a photosensitive drum, is disposed for each color along a transfer medium such as a transfer belt. Toner images formed by image forming stations are superimposed one atop the other on the transfer medium, whereby a color image is formed.

By the way, one of serious problems arising in an image forming apparatus comprising plural image forming stations is a color misregistration. This occurs as the transfer positions to which toner images formed by different image forming stations are transferred get displaced from each other, and shows as a change of hues. To solve this problem, reference pattern images (hereinafter referred to as "registration marks") for detecting a color misregistration may be formed in advance on a transfer medium and registration marks may be detected with an optical sensor to thereby calculate position information regarding the registration marks and align the respective toner images based on this position information (color misregistration correction). To be more specific, the position information regarding the registration marks is acquired through detection of edge portions of the registration marks. In short, while the transfer medium carrying the registration marks moves, (1) the position information is detected when upstream edge portions of the registration marks move passed the optical sensor and the level of an output from the optical sensor exceeds a pre-selected threshold level, or (2) the position information is detected when downstream edge portions of the registration marks move passed the optical sensor and the level of an output from the optical sensor exceeds a pre-selected threshold level.

Further, an image forming apparatus which uses an intermediate transfer belt may be a color image forming apparatus of the tandem type for instance. In this color image forming apparatus, image forming stations for yellow, magenta, cyan and black are disposed along the intermediate transfer belt, and toner images formed by the image forming stations are superimposed one atop the other on the intermediate transfer belt, whereby a color image is formed. The color image is then transferred at proper timing onto the recording medium.

The intermediate transfer belt is thus a major component of the image forming apparatus, and choice of a belt base material is important to secure a mechanical strength, a mechanical accuracy and the like in particular. Noting this, a conventional approach is to use a PC (polycarbonate) resin mainly made of polycarbonate considering a mechanical strength, a mechanical accuracy, etc., as described in JP-A-4-313757 for example.

SUMMARY OF THE INVENTION

For highly accurate color misregistration correction based on position information regarding registration marks in an image forming apparatus of the tandem type, the accuracy of detecting registration marks is important. However, the conventional techniques do not consider this sufficiently but merely use strip-like solid images as registration marks, thereby deteriorating the detection accuracy because of the so-called edge effect. To be more specifically, when two-dimensional solid images are formed in the manner described above, toner particles get concentrated particularly in edge portions of registration marks due to the edge effect. This locally enhances the density of toner in the edge portions of the registration marks and greatly varies an output signal from an optical sensor. The accuracy of detecting the registration marks based on the output signal from the optical sensor consequently decreases, leading to a problem that it is not possible to correct a color misregistration favorably and therefore printing proceeds with the color misregistration uncorrected or desired hues are not obtained.

Further, for highly accurate detecting the registration marks, considering environment factors are very important. However, the conventional techniques do not consider this sufficiently but merely use strip-like solid images as registration marks. Due to this, when the environment, e.g., the temperature changes, the variation of the output level from the optical sensor, caused by the detection of edge portions of the registration marks, may change. The above mentioned change of the variation affects the profiles of the output of the optical sensor greatly, the profiles are obtained when the upstream and downstream edge portion of the registration marks passed the optical sensor. That is, the level of the output from the optical sensor at the time of toner detection changes as denoted at the broken line, the solid line position detecting accuracy deteriorates. In addition, since the toner density in the edge portions of the registration marks locally increases due to the so-called edge effect, the toner density changes significantly particularly in the edge portions. Such a change of the toner density in the edge portions is particularly problematic during position detection relied upon detection of the edge portions of the registration marks described above. A change of the toner density associated with a change of the environment such as a temperature change thus deteriorates the position detecting accuracy of detecting the registration marks based on the output signal from the optical sensor, which may form a problem that color misregistration correction is not performed favorably and printing proceeds with the color misregistration uncorrected or desired hues are not obtained.

In the apparatus wherein a PC resin is used as the belt base material of an intermediate transfer belt, the intermediate transfer belt may be inferior in terms of the elasticity and transfer of a toner image may fail. Further, a color image forming apparatus of the tandem type may have the following problems. That is, noting that a color misregistration would manifest itself as changed hues, reference pattern images (hereinafter referred to as "registration marks") for detecting a color misregistration are formed in advance on an intermediate transfer belt, an optical sensor detect the respective registration marks, generating position information regarding the registration marks, and the respective toner images are aligned based on this position information (color misregistration correction) in the apparatus. However, since the intermediate transfer belt in which a PC resin is used as the belt base material is inferior in terms of the elasticity, detection of the registration marks transferred onto the intermediate transfer belt may fail. Upon failed detection of defects, the position detecting accuracy of detecting the registration marks drops down, leading to a problem that it is not possible to perform color misregistration correction favorably and therefore printing proceeds with the color misregistration uncorrected or a problem that desired hues are not obtained.

The invention has been made in light of these problems, and accordingly, aims at providing an image forming apparatus which is capable of forming registration marks while suppressing the edge effect, and hence, preventing a color misregistration, deteriorated hues, etc.

Further, the invention aims at providing an image forming apparatus which is capable of suppressing a deterioration of the position detecting accuracy of detecting registration marks due to a change of the environment such as a temperature change, and hence, preventing a color misregistration, deteriorated hues, etc.

Still further, the invention aims at providing an image forming apparatus which is capable of improving the elasticity of an intermediate transfer belt, and hence, forming a favorable image.

According to a first aspect of the present invention, an image forming apparatus comprised: a transfer medium which moves in a predetermined moving direction; a plurality of image forming stations, arranged along the moving direction, which form toner images of mutually different colors as registration marks on a surface of the transfer medium such that the toner images are spaced apart from each other along the moving direction; an optical sensor which detects each of the plural registration marks and outputs a signal; and a controller which corrects a color misregistration between/among the plural colors based on the output signal from the optical sensor, wherein each of the plural registration marks is formed by a two-dimensional pattern and a linear pattern which extends along a main scanning direction which is approximately orthogonal to the moving direction, and wherein the linear pattern and the two-dimensional pattern are spaced apart from each other along the moving direction.

According to a second aspect of the present invention, an image forming apparatus comprising: a transfer medium which moves in a predetermined moving direction; a plurality of image forming stations, arranged along the moving direction, which form toner images of mutually different colors as registration marks on a surface of the transfer medium such that the toner images are spaced apart from each other along the moving direction; an optical sensor which detects each of the plural registration marks and outputs a signal; and a controller which corrects a color misregistration between/among the plural colors based on the output signal from the optical sensor, wherein each of the plural registration marks is formed by a two-dimensional pattern and a first and a second linear patterns which extend along a main scanning direction which is approximately orthogonal to the moving direction, and wherein the first linear pattern, the two-dimensional pattern and the second linear pattern are placed in the order named in the moving direction, and are spaced apart from each other along the moving direction.

According to a third aspect of the present invention, an image forming apparatus comprising: a transfer medium which moves in a predetermined moving direction; a plurality of image forming stations, arranged along the moving direction, which form toner images of mutually different colors as registration marks on a surface of the transfer medium such that the toner images are spaced apart from each other along the moving direction; an optical sensor which detects each of the plural registration marks and outputs a signal; and a controller which corrects a color misregistration between/among the plural colors based on the output signal from the optical sensor, wherein each of the plural registration marks is a halftone toner image.

According to a forth aspect of the present invention, an image forming apparatus comprising: an image former which forms a toner image; and an intermediate transfer belt which rotates along a predetermined direction and temporarily carries the toner image which is transferred onto, wherein the intermediate transfer belt uses a belt base material of thermoplastic elastomer alloy whose principal alloy ingredient is thermoplastic elastomer.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 3 is a drawing which shows the image writer uses an array-like write head.

FIG. 4A is a drawing which shows a latent image pattern shaped like a 1-dot line is formed on the photosensitive drum.

FIG. 4B is a drawing which shows a latent image pattern of an n-dot line is formed on the photosensitive drum.

FIG. 5A and FIG. 5B are drawings which show operations of the image forming apparatus which is shown in FIG. 1.

FIG. 11A and FIG. 11B are drawings which show operations of the image forming apparatus which is shown in FIG. 1.

FIG. 12A and FIG. 12B are diagrams for explaining the effect of the invention.

FIGS. 13A through 13H are drawings which show the two-dimensional halftone pattern.

FIG. 18 is a drawing of a sensor which is disposed near a drive roller.

DETAILED DESCRIPTION OF THE PREFERRED EMBODIMENTS

First Embodiment

Figure 1:
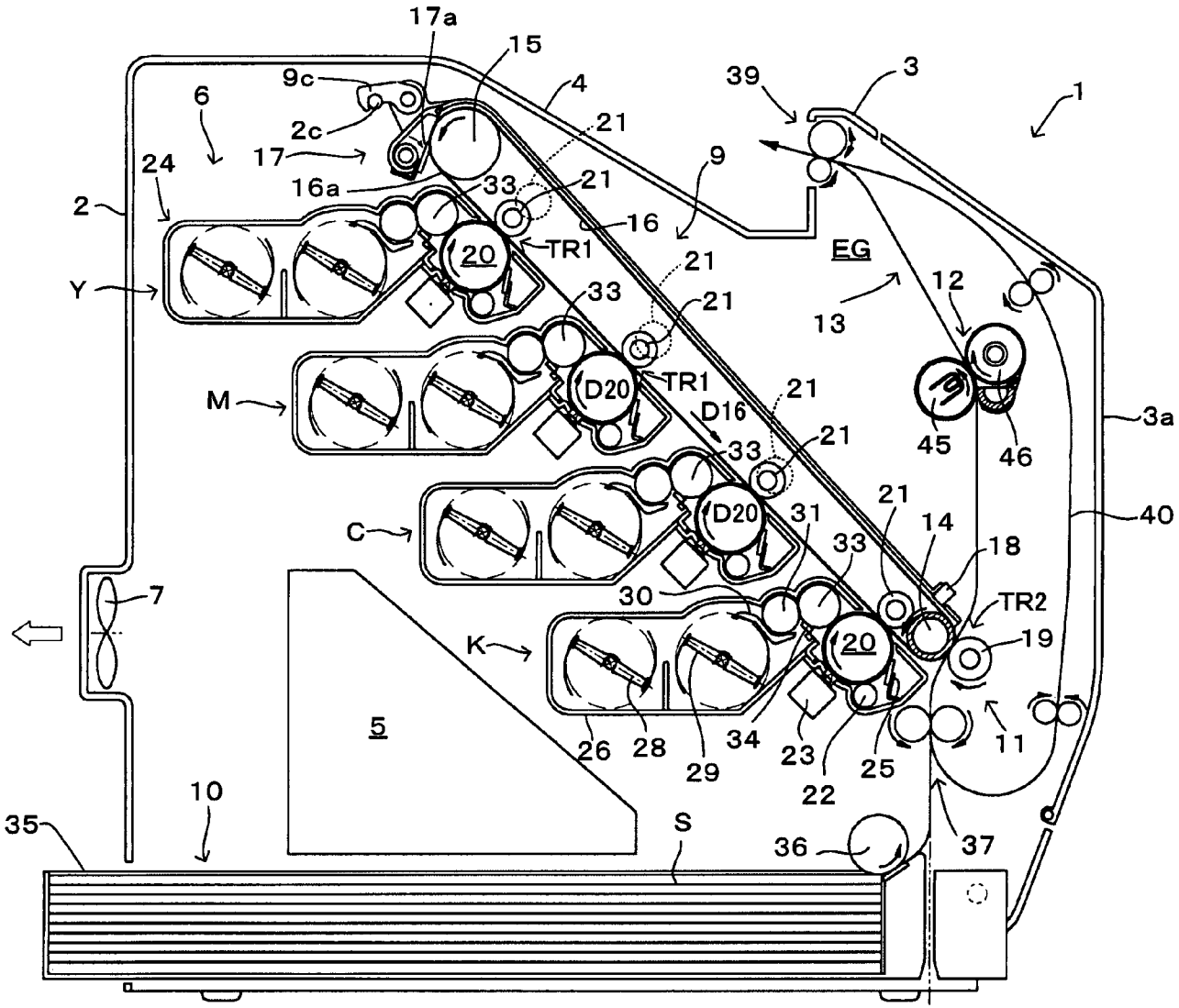
FIG. 1 is a drawing which shows an embodiment of an image forming apparatus according to the present invention.
Figure 2:
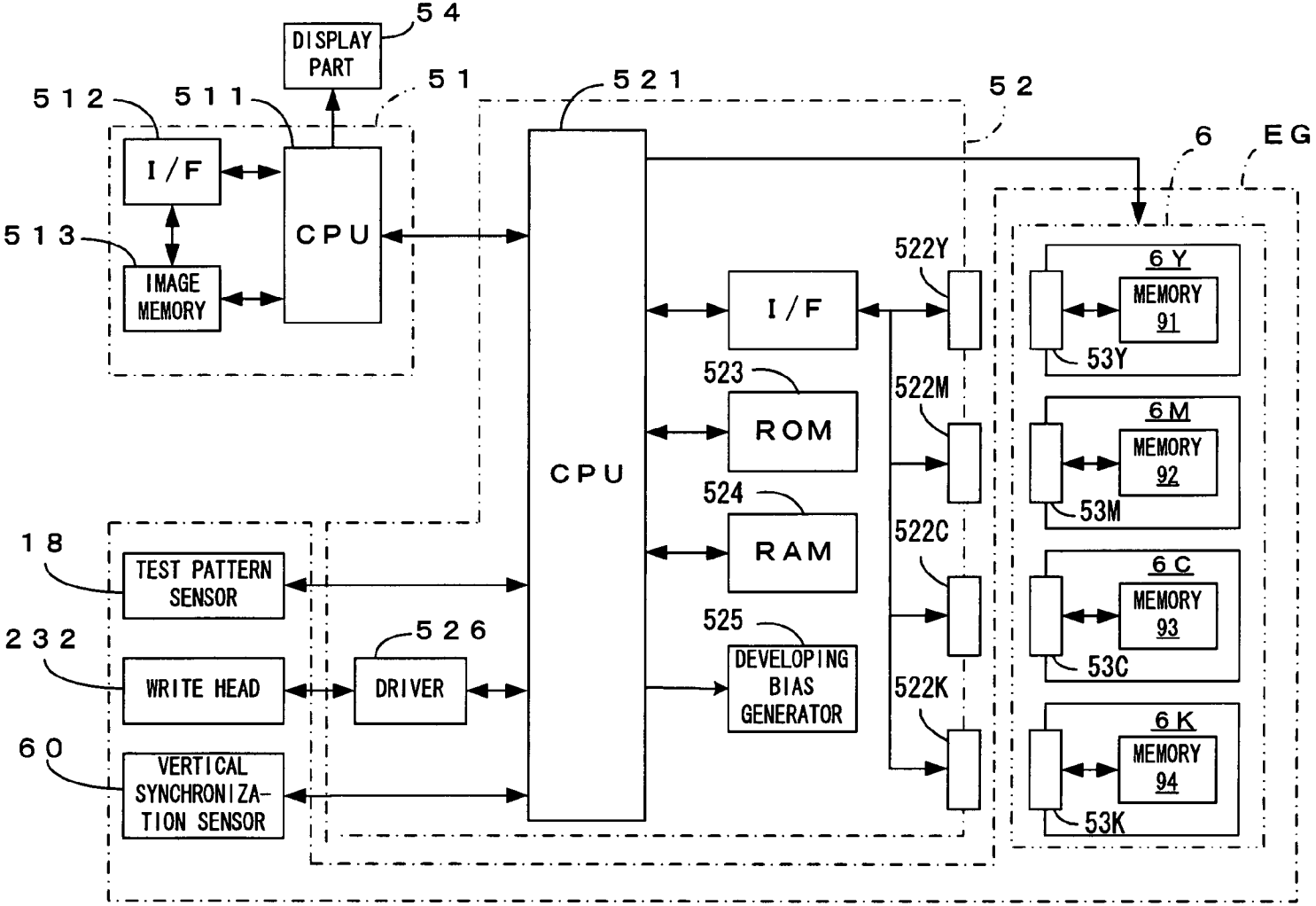
FIG. 2 is a block diagram which shows an electric structure of the image forming apparatus of FIG. 1.

FIG. 1 is a drawing which shows an embodiment of an image forming apparatus according to the present invention. FIG. 2 is a block diagram which shows an electric structure of the image forming apparatus of FIG. 1. The image forming apparatus 1 is an image forming apparatus which selectively executes color printing of superimposing toner (developing agents) in four colors of black (K), cyan (C), magenta (M) and yellow (Y) and accordingly forming a full-color image or monochromatic printing of forming a monochrome image using only black (K) toner. In the image forming apparatus 1, as a main controller 51 receives an image formation command (print command) from an external apparatus such as a host computer, an engine controller 52 controls respective parts of an engine part EG in accordance with a command from the main controller 51, a predetermined image forming operation is executed, and an image corresponding to the image formation command is formed on a sheet (recording material) S which may be a copy paper, a transfer paper, a plain paper or a transparency for an over-head projector.

In FIG. 1, the image forming apparatus 1 according to the embodiment comprises a main housing 2, a first open/close member 3 which is attached to the front face (the right side surface in FIG. 1) of the main housing 2 such that it can freely open and close, and a second open/close member 4 which (serves also as a paper discharge tray and) is attached to the top surface of the main housing 2 such that it can freely open and close. To the first open/close member 3, an opening lid 3*a* is attached in the front face of the main housing 2 such that the opening lid 3*a* can freely open and close. Working with the first open/close member 3 or independently, the opening lid 3*a* can open and close.

Inside the main housing 2, there is an electrical equipment box 5 which incorporates a power source circuit substrate, the main controller 51 and the engine controller 52. Also disposed inside the main housing 2 are an image formation unit 6, a blast fan 7, a transfer belt unit 9 and a paper feed unit 10. A secondary transfer unit 11, a fixing unit 12 and a sheet transport mechanism 13 are disposed to the first open/close member 3. In this embodiment, consumables inside the image formation unit 6 and the paper feed unit 10 are made freely attachable to and detachable from a main section of the apparatus. The consumables and the transfer belt unit 9 are structured so that it is possible to detach these and repair or replace.

The transfer belt unit 9 comprises a drive roller 14 which is disposed in a lower section of the main housing 2 and driven into rotations by a black-color drive motor which will be described later, a follower roller 15 which is disposed at an upper diagonal position relative to the drive roller 14, an intermediate transfer belt 16 which runs across these two rollers 14 and 15 and is driven to rotate along the arrow direction (moving direction) D16 shown in FIG. 1, and a belt cleaner 17 which abuts on the surface of the intermediate transfer belt 16. The follower roller 15 is disposed at an upper diagonal position relative to the drive roller 14 (i.e., upper left in FIG. 1). Due to this, the intermediate transfer belt 16 rotates in the direction D16 as it is inclined. A belt surface 16*a* is faced downward in which the belt transporting direction D16 is toward below (i.e., toward lower right in FIG. 1) when the intermediate transfer belt 16 is driven. In this embodiment, the belt surface 16*a* serves as a belt tension surface (surface pulled by the drive roller 14) when the belt is driven, and the circumferential speed of the belt surface 16*a* is slower than that of a photosensitive drum (image carrier) 20 for each color. As the circumferential speed of the intermediate transfer belt 16 is slower than that of each photosensitive drum 20, the photosensitive drums 20 are driven as if pulled in a direction which slows rotations by the intermediate transfer belt 16.

The drive roller 14 serves also as a backup roller for a secondary transfer roller 19. The drive roller 14 seats in its circumference surface a rubber layer whose thickness is about 3 mm and whose volume resistivity is 100KΩ·cm or lower. Grounding via a metal shaft, the drive roller 14 establishes a conductive path for a secondary transfer bias which is supplied from a secondary transfer bias generator not shown via the secondary transfer roller 19. Since the drive roller 14 bears the rubber layer which is highly frictional and absorbs impact, impact associated with entry of a sheet S to a secondary transfer unit is not transmitted easily to the intermediate transfer belt 16, thereby making it possible to prevent a deterioration of the quality of an image.

Further, in this embodiment, the diameter of the drive roller 14 is smaller than that of the follower roller 15. This ensures that a sheet S as it is after secondary transfer gets peeled off easily due to its own elasticity. In addition, the follower roller 15 serves also as a backup roller for the belt cleaner 17. The belt cleaner 17 is disposed closer to the belt surface 16*a* which is faced downward along the transporting direction. As shown in FIG. 1, it comprises a cleaning blade 17*a* which removes residual toner and a toner transporting member which transports removed toner. The cleaning blade 17*a* abuts on the intermediate transfer belt 16 in a winding section over which the intermediate transfer belt 16 follows the follower roller 15, and cleans and removes toner which still remains in the surface of the intermediate transfer belt 16 after secondary transfer.

A support frame (not shown) of the transfer belt unit 9 supports the drive roller 14 and the follower roller 15 such that the rollers can freely rotate. Further, primary transfer rollers 21 are disposed to a back surface to the belt surface 16*a* which is faced downward along the transporting direction of the intermediate transfer belt 16 so that the primary transfer rollers 21 are opposed against the photosensitive drums 20 of the image forming stations Y, M, C and K which will be described later. These four primary transfer rollers 21 are axially supported by the support frame for free rotations and electrically connected with a primary transfer bias generator not shown, and the primary transfer bias generator applies a primary transfer bias upon the primary transfer rollers 21 at proper timing.

The support frame described above can freely revolve relative to the main housing 2 about the drive roller 14 along the arrow direction D21. As an actuator not shown operates, the support frame revolves, thereby moving the primary transfer rollers 21, which are disposed facing the photosensitive drums 20 of the image forming stations Y, M and C for yellow (Y), magenta (M) and cyan (C), closer toward or away from the photosensitive drums 20. Hence, the primary transfer rollers 21 for yellow, magenta and cyan moving closer to the photosensitive drums 20 abut on the photosensitive drums 20 across the intermediate transfer belt 16 (as denoted at the solid lines in FIG. 1). These abutting positions are primary transfer positions at which toner images get transferred onto the intermediate transfer belt 16. Conversely, as the primary transfer rollers 21 for yellow, magenta and cyan move away from the photosensitive drums 20, the photosensitive drums 20 of the image forming stations Y. M and C and the intermediate transfer belt 16 move away from each other (as denoted at the broken lines in FIG. 1). Meanwhile, the primary transfer roller 21 disposed facing the photosensitive drum 20 of the image forming station K for black (K), by its structure, rotates while abutting on the photosensitive drum 20 across the intermediate transfer belt 16. Thus, as all primary transfer rollers 21 move toward the photosensitive drums 20 as denoted at the solid lines in FIG. 1, color printing becomes possible. On the contrary, as denoted at the broken lines in FIG. 1, when all the other primary transfer rollers 21 move away from the photosensitive drums 20 except for the black primary transfer roller 21, the intermediate transfer belt 16 move away from the image forming stations Y, M and C and no printing occurs in yellow, magenta or cyan while monochromatic printing takes place. The black primary transfer roller 21 may be structured to move away from the associated photosensitive drum 20 if necessary.

A test pattern sensor 18 is also disposed as the "optical sensor" of the invention to the support frame of the transfer belt unit 9 such that the test pattern sensor 18 is in proximity of the drive roller 14. The test pattern sensor 18 is an optical sensor of the so-called reflection type, and comprises a light projector (not shown) which irradiates light toward the surface of the intermediate transfer belt 16 and a light receiver (not shown) which receives light reflected by the surface of the intermediate transfer belt 16, registration marks which will be described later, etc. While the light projector irradiates light upon registration marks on the intermediate transfer belt 16, the light receiver receives light from the registration marks, and the test pattern sensor 18 outputs a signal corresponding to the amount of light which the light receiver has received. Toner images on the intermediate transfer belt 16 are aligned to each other based on the output signal from the test pattern sensor 18, the densities of the respective toner images are detected, and a color misregistration, the densities or the like of the respective color images are corrected. The structure of registration marks according to this embodiment will be described later.

Further, in this embodiment, in addition to the test pattern sensor 18, a vertical synchronization sensor 60 (FIG. 2), which detects characteristics sections (which may be projections protruding along the width direction for instance) of the intermediate transfer belt 16, is attached to the support frame. Hence, every time the characteristics sections of the intermediate transfer belt 16 move passed the sensor 60, a vertical synchronization signal (reference signal) is output.

The image formation unit 6 comprises the image forming stations Y (yellow), M (magenta), C (cyan) and K (black) which form images in plural (four in this embodiment) different colors. The image forming stations Y, M, C and K correspond to the "image formers" of the invention and the photosensitive drum 20 is disposed for each of them. Around each photosensitive drum 20, a charger 22, an image writer 23, a developer 24 and a photosensitive drum cleaner 25 are disposed. These functional parts perform a charging operation, a latent image forming operation and a development-with-toner operation. In FIG. 1, the respective image forming stations inside the image formation unit 6 have identical structures, and therefore, for the convenience of illustration, reference symbols are assigned to only some image forming stations, leaving the other image forming stations denoted at no reference symbols. The image forming stations Y, M, C and K may be disposed in any order.

The photosensitive drums 20 of the image forming stations Y, M, C and K are disposed so that they come abutting at primary transfer positions TR1 on the belt surface 16*a* of the intermediate transfer belt 16 which is faced downward along the transporting direction. The photosensitive drums 20 are connected respectively with dedicated drive motors, and as denoted at the arrow direction D20, driven to rotate at a predetermined circumferential speed in the transporting direction of the intermediate transfer belt 16.

The charger 22 comprises a charger roller whose surface is made of elastic rubber. The charger roller abuts on the surface of the photosensitive drum 20 at a charging position and rotates following the photosensitive drum 20. As the photosensitive drum 20 rotates, the charger roller follows the rotations of the photosensitive drum 20 at the circumferential speed in a driven direction. Further, the charger roller is connected with a charging bias generator (not shown), and when applied with a charging bias, charges up the surface of the photosensitive drum 20 at a charging position.

The image writer 23 uses an array-like write head 232 in which light emitting diodes 231 are arranged in a row along the axial direction of the photosensitive drum 20 as shown in FIG. 3, and is located away from the photosensitive drum 20. In short, the multiple light emitting diodes 231 are arranged in one row in a main scanning direction X which is approximately orthogonal to the transporting direction (corresponding to the "moving direction" of the invention) D16 in which the intermediate transfer belt 16 is driven, and when all light emitting diodes 231 are lit up at the same time by a driver 526 shown in FIG. 2, as shown in FIG. 4A, a latent image pattern shaped like a 1-dot line is formed on the photosensitive drum 20. As the intermediate transfer belt 16 moves n dots (n=2, 3, . . . ) while all light emitting diodes 231 remain lit up, a latent image pattern of an n-dot line is formed as shown in FIG. 4B. When this line latent image is developed with toner, the "linear pattern" of the invention is formed. Of course, it is possible to form various types of two-dimensional patterns or two-dimensional halftone patterns when the respective light emitting diodes 231 are controlled to turn on or off in accordance with a drive command from the driver 526.

The array-like write head 232 having such a structure is advantageous in that it is compact with a shorter optical path length than that of a laser scanning optical system, that it can be disposed in the vicinity of the photosensitive drum 20 and that it is therefore possible to reduce the size of the apparatus as a whole. In this embodiment, the photosensitive drum 20, the charger 22, the developer 24 and the photosensitive drum cleaner 25 of each image forming station Y, M, C or K are put together as a unit which is a replacement cartridge 6Y, 6M, 6C or 6K (FIG. 2). Non-volatile memories 91 through 94 are disposed to the replacement cartridges 6Y, 6M, 6C and 6K respectively, for storage of information regarding the replacement cartridges. Transmitters 53Y, 53M, 53C and 53K disposed to the respective replacement cartridges and transmitters 522Y, 522M, 522C and 522K disposed to the main section of the apparatus are respectively disposed in the vicinity of each other, which enables wireless communication between a CPU 521 of the engine controller 52 and the memories 91 through 94. In this manner, information regarding the respective replacement cartridges is transmitted to the CPU 521 and information inside the memories 91 through 94 is updated.

The details of the developers 24 will now be described, referring to the image forming station K. The developers 24 is comprised of a toner storage container 26 for holding toner, two toner agitate/supply members 28 and 29 disposed inside the toner storage container 26, a partition member 30 which is disposed in the vicinity of the toner agitate/supply member 29, a toner feed roller 31 which is disposed above the partition member 30, a developing roller 33 which abuts on the toner feed roller 31 and the photosensitive drum 20 and rotates at a predetermined circumferential speed in the arrow direction in FIG. 1, and a regulating blade 34 which abuts on the developing roller 33.

In each developer 24, toner agitated and carried upward by the toner agitate/supply member 29 is supplied to the toner feed roller 31 along the top surface of the partition member 30. Thus supplied toner is then supplied to the surface of the developing roller 33 via the toner feed roller 31. The regulating blade 34 regulates the toner supplied to the developing roller 33 into a predetermined layer thickness and the toner is then transported to the photosensitive drum 20. Developing bias generator 525 connected with the developing roller 33 supplies a developing bias upon the developing roller 33.Then charged toner moves from the developing roller 33 to the photosensitive drum 20 at a developing position where the developing roller 33 abuts on the photosensitive drum 20, and electrostatic latent images formed by image writer 23 are visualized.

Further, in this embodiment, on the downstream side relative to the primary transfer position TR1 along the direction D20 in which the photosensitive drum 20 rotates, the photosensitive drum cleaner 25 is disposed abutting on the surface of the photosensitive drum 20. When abutting on the surface of the photosensitive drum 20, the photosensitive drum cleaner 25 cleans residual toner on the surface of the photosensitive drum 20 which remains after primary transfer and cleans the surface of the photosensitive drum 20.

The paper feed unit 10 comprises a paper feed part formed by a paper feed cassette 35 which holds a stack of sheets S and a pick-up roller 36 which feeds the sheets S one by one from the paper feed cassette 35. Disposed inside the first open/close member 3 are paired registration rollers 37 determining the timing of feeding a sheet S to a secondary transfer region TR2, the secondary transfer roller 19 which is brought into pressure contact with the drive roller 14 and the intermediate transfer belt 16 and serves as a secondary transfer element, the fixing unit 12, paired paper discharge rollers 39 and a double-sided printing transport path 40.

Driven by a secondary transfer roller drive mechanism (not shown), the secondary transfer roller 19 is disposed such that it can abut on and leave the intermediate transfer belt 16. The fixing unit 12 comprises a heating roller 45, which incorporates a heating element such as a halogen heater and is capable of freely rotating, and a pressure roller 46 which presses and urges the heating roller 45. An image secondarily transferred onto a sheet S is fixed by a nip portion, which is formed by the heating roller 45 and the pressure roller 46, on the sheet S at a predetermined temperature. In this embodiment, it is possible to dispose the fixing unit 12 inside a space which is created diagonal above the intermediate transfer belt 16, that is, a space on the opposite to the image formation unit 6 with respect to the intermediate transfer belt 16, and therefore, reduce transmission of heat to the electrical equipment box 5, the image formation unit 6 and the intermediate transfer belt 16 and decrease the frequency of executing an operation of correcting displacement of the respective colors.

The sheet S as it is after the fixing is fed via the paired paper discharge rollers 39 to the second open/close member (paper discharge tray) 4 which is disposed to the top surface of the main housing 2. For formation of images on the both surfaces of the sheet S, the paired paper discharge rollers 39 reverse their direction of rotations when the rear end of the sheet S whose one surface bears an image as described above arrive an inversion position behind the paired paper discharge rollers 39, thereby transporting the sheet S along the double-sided printing transport path 40. While the sheet S is returned back again to the transport path before paired registration rollers 37, the surface of the sheet S which abuts on the intermediate transfer belt 16 in the secondary transfer region TR2 and is to receive an image is, at this stage, the opposite surface to the surface which already bears the image. In this fashion, it is possible to form images on the both surfaces of the sheet S.

Further, this apparatus 1 comprises a display part 54 which is controlled by a CPU 511 of the main controller 51 as shown in FIG. 2. The display part 54 is formed by a liquid crystal display for instance, and shows in response to a control command from the CPU 511 a predetermined message to provide guidance regarding operations to a user and inform the status of the progressing image forming operation, occurrence of abnormality inside the apparatus, the timing of replacing any one of the units, etc.

In FIG. 2, denoted at 513 is an image memory disposed to the main controller 51 for storage of an image which is provided via an interface 512 from an external apparatus such as a host computer. Denoted at 523 is a ROM which stores a computation program executed by the CPU 521, control data for control of the engine part EG, etc. Denoted at 524 is a RAM which temporarily stores a computation result derived by the CPU 521, other data, etc.

FIG. 5A and FIG. 5B are drawings of operations of the image forming apparatus which is shown in FIG. 1. This apparatus executes color misregistration correction which utilizes registration marks at appropriate timing which may be power-on, cartridge exchange or the like. To be more specific, the CPU 521 of the engine controller 52 controls the respective portions of the apparatus in accordance with a program stored in the ROM 523 regarding the color misregistration correction, whereby registration marks are formed and detected and the color misregistration correction is executed.

Figures 6A, 6B, 6C, 6D:
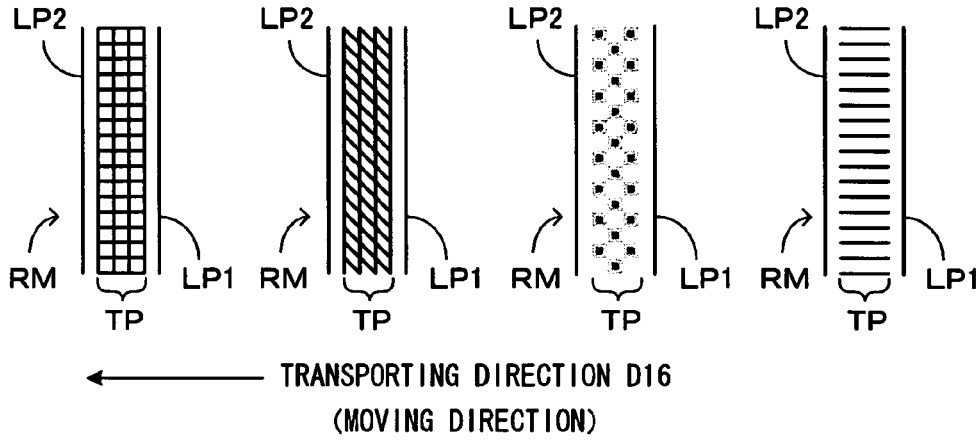
FIG. 6A, FIG. 6B, FIG. 6C and FIG. 6D are drawings which show the two-dimensional patterns.
Figures 7A, 7B, 7C, 7D:
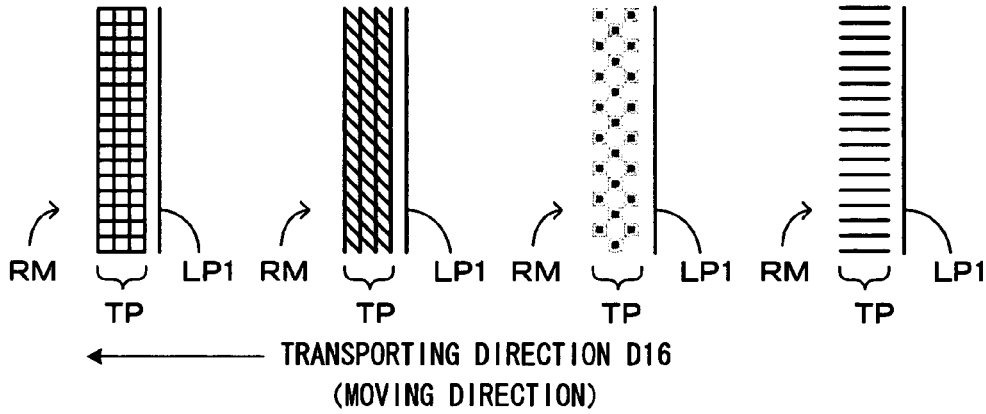
FIG. 7A, FIG. 7B, FIG. 7C and FIG. 7D are drawings which show registration marks.
Figures 8A, 8B, 8C, 8D:
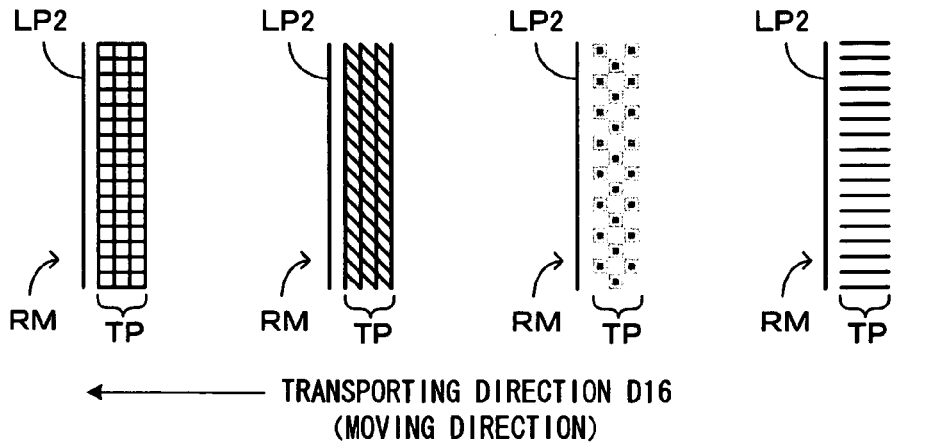
FIG. 8A, FIG. 8B, FIG. 8C and FIG. 8D are drawings which show registration marks.

First, the image forming stations Y, M, C and K form registration marks RM, i.e., a combination of linear patterns and two-dimensional patterns, in response to a control command from the CPU 521 of the engine controller 52. The total size of each registration mark RM, the distances between the multiple registration marks RM formed on the intermediate transfer belt 16, the arrangement, the number and the like of the registration marks RM may be determined freely, and numerous various examples have been proposed in this regard. This embodiment requires, as shown in FIG. 5A for example, forming in a part of the surface of the intermediate transfer belt 16 the registration marks RM shaped like stripes (whose width is 0.5 mm for instance) which extend parallel along the main scanning direction X which is orthogonal to the transporting direction D16 in which the intermediate transfer belt 16 is driven such that the registration marks RM are apart from each other by a predetermined gap (which may be 0.5 mm for instance) along the transporting direction (sub scanning direction or moving direction) D16 in the order of K, C, M and Y Although FIG. 6A shows only the yellow registration mark RM(Y), the black registration mark RM(K), the cyan registration mark RM(C) and the magenta registration mark RM(M) and the yellow registration mark RM(Y), plural registration marks are formed for each color.

The structure of the yellow registration mark RM(Y) will now be described with reference to FIG. 5B which enlarges the yellow registration mark RM(Y). In this embodiment, as shown in FIG. 5B, the yellow registration mark RM(Y) is a toner image which is formed by a first linear pattern LP1 and a second linear pattern LP2 which extend along the main scanning direction X and a two-dimensional pattern TP, and the first linear pattern LP1, the two-dimensional pattern TP and the second linear pattern LP2 are spaced apart from each other in this order along the transporting direction D16. In addition, this embodiment uses a solid image pattern as the two-dimensional pattern TP. Although the yellow registration mark RM(Y) has been described, the registration marks RM(K), RM(C) and RM(M) of the other colors have similar structures.

As all or some of the registration marks RM having such structures are formed, the light projector (not shown) of the test pattern sensor (optical sensor) 18 turns on, which makes it possible for the test pattern sensor 18 to detect the registration marks RM. That is, the registration marks RM(K), RM(C), RM(M) and RM(Y) formed on the intermediate transfer belt 16 in the manner above move along the transporting direction D16 as the intermediate transfer belt 16 moves, and further move passed a detection area 181 of the test pattern sensor 18. At this stage, the voltage level of the signal output from the test pattern sensor 18 representing light which the light receiver (not shown) of the test pattern sensor 18 receives changes in accordance with the amount of received light. Hence, measurement of the voltage level makes it possible to measure the timing at which each registration mark RM passed the test pattern sensor 18 and acquire position information regarding the registration marks RM. It is therefore possible to calculate the gaps between the registration marks RM based on this position information. As the position information regarding all registration marks RM is obtained, the color misregistration correction is carried out based on the position information.

As described above, since the respective registration marks RM have the structures above in this embodiment, it is possible to detect the position information regarding the registration marks RM at a high accuracy. This enables execution of proper color misregistration correction. The reason is as follows. In the event that the registration marks are formed only by two-dimensional patterns TP as in the conventional techniques, due to the edge effect, toner gets concentrated in the edge portions of the registration marks RM and the densities of the edge portions become higher than those at central sections of the registration marks RM. Density changes particularly in those edge portions approximately orthogonal to the transporting direction D16 (the right and the left edge portions in FIG. 5B) are large, which in turn significantly changes the output from the test pattern sensor 18. On the contrary, the linear patterns LP1 and LP2 which extend along the main scanning direction X are spaced apart from the two-dimensional pattern TP, one toward the upstream side and the other toward the downstream side, along the transporting direction D16 in this embodiment. Hence, the edge effect in the transporting direction D16 is suppressed and the test pattern sensor 18 accurately detects the positions of the registration marks RM. The line width of the linear patterns LP1 and LP2 along the transporting direction D16 and the gaps of the linear patterns LP1 and LP2 from the two-dimensional pattern TP are closely related to suppression of the edge effect, and therefore, it is possible to appropriately determine experimentally, by simulation, etc.

The present invention is not limited to the embodiments above, but may be modified in various manners in addition to the preferred embodiments above, to the extent not deviating from the object of the invention. For instance, although the embodiment above uses a solid image patterns as the two-dimensional patterns TP, the two-dimensional patterns TP are not limited to this but may be any desired patterns. For instance, as shown in FIGS. 6A through 6D, the two-dimensional patterns TP may be:

A grid-like patterns formed by vertical lines extending along the main scanning direction X and transverse lines extending along the transporting direction D16;

B grid-like patterns formed by lines extending along the main scanning direction X and inclined lines;

C screen patterns which are screened; or

D stripe patterns formed by linear lines.

Where position information is to be detected from changes of the output signal which is obtained as upstream parts of the registration marks RM on the intermediate transfer belt 16 move along the transporting direction D16 and passed the detection area 181 of the test pattern sensor 18, suppression of the edge effect on the upstream side is important. When such a detection method is adopted therefore, as shown in FIG. 7A, FIG. 7B, FIG. 7C, and FIG. 7D, a registration mark RM may be formed by an upstream linear pattern LP1 and a two-dimensional pattern TP. On the contrary, where position information is to be detected from changes of the output signal which are obtained as downstream parts of the registration marks RM on the intermediate transfer belt 16 move along the transporting direction D16 and passed the detection area 181 of the test pattern sensor 18, suppression of the edge effect on the downstream side is important. When such a detection method is adopted therefore, as shown in FIG. 8A, FIG. 8B, FIG. 8C, FIG. 8D, a registration mark RM may be formed by a downstream linear pattern LP2 and a two-dimensional pattern TP.

Figure 9:
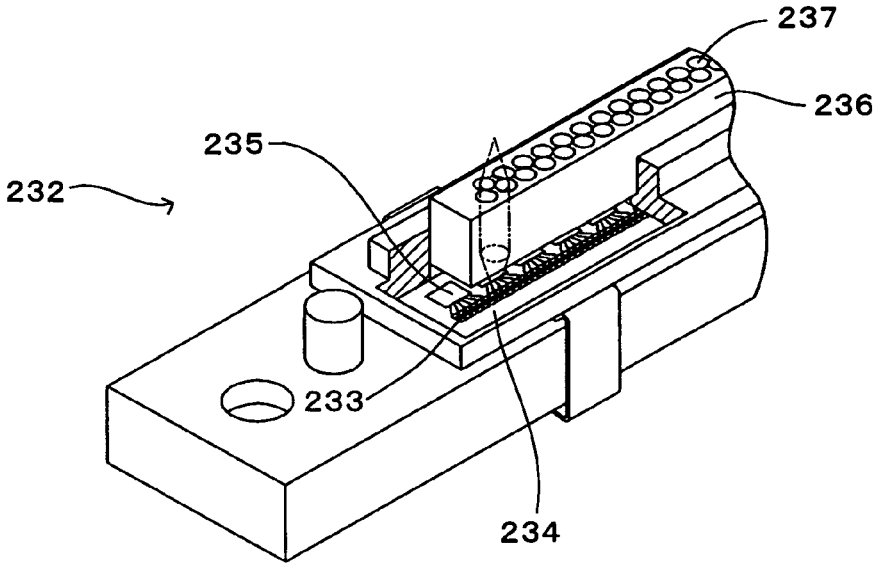
FIG. 9 is a schematic perspective view of an image writer which uses organic EL(electroluminescence) elements.

Further, the image writer is formed by the array-like write head 232 which is formed by lining up the light emitting diodes 231 in a row as light emitting elements in this embodiment, the light emitting elements may be organic EL elements for instance. FIG. 9 is a schematic perspective view of an image writer which uses organic EL elements. FIG. 9 shows details of a line head which is disposed in the image writer 23. In the write head 232 of each image writer 23, a light emitting array formed by organic EL elements 233 is held inside a long housing. In the image writer 23, a light emitting part of the light emitting array formed by the organic EL elements 233 is mounted on a glass substrate 234, and TFTs 235 formed on the same glass substrate 234 drive the image writer 23. A refractive index distribution rod lens array 236 forms an imaging optical system, and refractive index distribution rod lenses 237 are arranged densely in the front face of the light emitting part. The housing covers the area around the glass substrate 234, and the side opposed against the photosensitive drum 20 is open. This realizes emission of a light beam from the refractive index distribution rod lenses 237 toward the photosensitive drum 20. The surfaces of the housing opposed against the edge surfaces of the glass substrate 234 seat optical absorbing members (paint).

Figure 10:
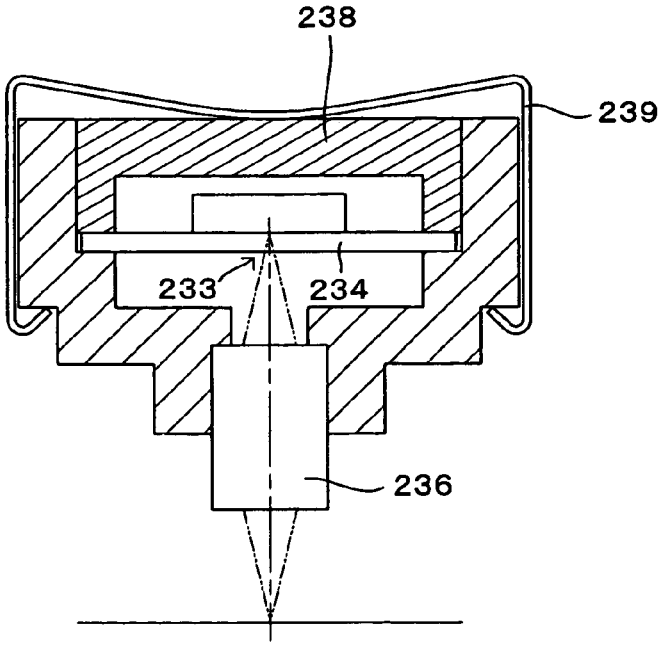
FIG. 10 is a cross sectional view of the image writer taken along a sub scanning direction.

FIG. 10 is a cross sectional view of the image writer taken along the sub scanning direction. The image writer 23 comprises the light emitting array, which is formed by the organic EL elements 233 attached facing the rear surface of the refractive index distribution rod lens array 236 within the housing, and an opaque cover 238 which blocks the light emitting array formed by the organic EL elements 233 from the back surface of the housing. A fixed plate spring 239 presses the cover 238 against the back surface of the housing, thereby sealing up the inside of the housing light-tight. In short, the glass substrate 234 is sealed up light-tight by the fixed plate spring 239. Hence, it is possible to prevent total reflection at the edge surfaces of the glass substrate 234 and efficiently absorb light. There are plural such fixed plate springs 239 at plural locations along the longitudinal direction of the housing.

Alternatively, the write head may include a row-like arrangement of elements, such as liquid crystal shutters, comprising back lights along the axial direction of the photosensitive drum 20. Of course, an image writer formed by a laser scanning optical system may be used.

Further, the embodiment above is an application of the invention to an image forming apparatus which forms registration marks on the intermediate transfer belt 16, the scope of applications of the invention is not limited to this. The invention is generally applicable also to any apparatus which forms registration marks for color misregistration processing on a transfer medium such as an intermediate transfer drum or a transfer sheet.

Second Embodiment

FIG. 11A and FIG. 11B is a drawing which shows operations of the image forming apparatus which is shown in FIG. 1 according to the second embodiment. This apparatus executes the color misregistration correction which utilizes registration marks at appropriate timing which may be power-on, cartridge exchange or the like. To be more specific, the CPU 521 of the engine controller 52 controls the respective portions of the apparatus in accordance with a program stored in the ROM 523 regarding the color misregistration correction, whereby registration marks are formed and detected and the color misregistration correction is executed in the following manner.

First, in response to a control command from the CPU 521 of the engine controller 52, the image forming stations Y, M, C and K form, as registration marks RM, halftone toner images formed by two-dimensional halftone patterns of plural lines which extend along the main scanning direction which is orthogonal to the transporting direction D16 as shown in FIG. 11A. The total size of each registration mark RM, the distances between the multiple registration marks RM formed on the intermediate transfer belt 16, the arrangement, the number and the like of the registration marks RM may be determined freely, and numerous various examples have been proposed in this regard. This embodiment requires, as shown in FIG. 11A for example, forming the registration marks RM such that the registration marks RM are apart from each other by a predetermined gap (which may be 0.5 mm for instance) along the transporting direction (sub scanning direction or moving direction) D16 in the order of K, C, M and Y Although FIG. 11A shows only the yellow registration mark RM(Y), the black registration mark RM(K), the cyan registration mark RM(C) and the magenta registration mark RM(M) and the yellow registration mark RM(Y), plural registration marks are formed for each color.

The structure of the yellow registration mark RM(Y) will now be described with reference to FIG. 11B which enlarges the yellow registration mark RM(Y). In this embodiment, as shown in FIG. 11B, the registration mark RM(Y) is formed by a halftone toner image which may be a two-dimensional halftone pattern of plural lines which extend along the main scanning direction which is orthogonal to the transporting direction D16. Although the yellow registration mark RM(Y) has been described, the registration marks RM(K), RM(C) and RM(M) of the other colors have similar structures.

As all or some of the registration marks RM having such structures are formed, the light projector (not shown) of the test pattern sensor (optical sensor) 18 turns on, which makes it possible for the test pattern sensor 18 to detect the registration marks RM. That is, the registration marks RM(K), RM(C), RM(M) and RM(Y) formed on the intermediate transfer belt 16 in the manner above move along the transporting direction D16 as the intermediate transfer belt 16 moves, and further passed a detection area 181 of the test pattern sensor 18. At this stage, the voltage level of the signal output from the test pattern sensor 18 representing light which the light receiver (not shown) of the test pattern sensor 18 receives changes in accordance with the amount of the received light. At certain timing, the output voltage from the test pattern sensor 18 traverses a threshold voltage which has been set in advance. Hence, measurement of this timing makes it possible to measure the timing at which each registration mark RM moves passed the test pattern sensor and acquire position information regarding the registration marks RM. To be more specific, a comparator (not shown) compares the optical sensor output with the threshold voltage, and switching of an output from the comparator is detected. This allows acquisition of the position information regarding the registration marks RM. It is therefore possible to calculate the gaps between the registration marks RM based on the position information. As the position information regarding all registration marks RM is obtained, the color misregistration correction is carried out based on the position information.

As described above, since the respective registration marks RM have the structures above in this embodiment, it is possible to detect the position information regarding the registration marks RM at a high accuracy. This enables execution of proper color misregistration correction. The reason is as follows. In the event that the registration marks are formed by solid images as in the conventional techniques, a toner density change attributable to a change of the environment such as a temperature change shows as a change of the level of the output from the optical sensor as described above, the timing that the level of the output from the optical sensor traverses the threshold level changes as denoted at the symbols T1 through T3 in FIG. 12A. In consequence, the position detecting accuracy drops and it becomes difficult to properly execute the color misregistration correction. On the contrary, the embodiment, requiring that a halftone toner image formed by a two-dimensional halftone pattern as that shown in FIG. 11A, which is formed by plural lines extending along the main scanning direction which is orthogonal to the transporting direction D16, is used as each registration mark RM, suppresses a toner density change caused by a change of the environment such as a temperature change and stabilizes the level of the output from the test pattern sensor (optical sensor) 18. Hence, the timing that the output level of the optical sensor traverses the threshold level is stable as denoted at the symbols T4 through T6 in FIG. 12B. This improves the position detecting accuracy of detecting registration marks RM and realizes appropriate color misregistration correction.

Although the embodiment above uses the two-dimensional halftone pattern as that shown in FIG. 13A as the two-dimensional halftone pattern, the two-dimensional halftone pattern is not limited to this but any desired pattern may be used as the two-dimensional halftone pattern. The two-dimensional halftone patterns as those shown in FIGS. 13B through 13H may be used for example. Use of the two-dimensional halftone patterns as those shown in FIGS. 13D through 13H in particular is preferable as it suppresses toner density unevenness (banding) on the transfer medium such as the intermediate transfer belt 16 in the transporting direction. The reason is as follows. The two-dimensional halftone patterns as those shown in FIGS. 13A through 13C are formed only by dots or straight lines extending along the main scanning direction which is orthogonal to the transporting direction D16, and therefore, the presence of toner is discontinuous along the transporting direction D16. Hence, there is a period in which the photosensitive drum 20 carrying a toner image contacts the intermediate transfer belt 16 via toner and a period in which they contact each other without involvement of toner at all. During the period in which they contact each other through toner, the frictional resistance between the two is great, whereas during the period in which they contact each other without toner, the frictional resistance between the two is small. Such a change of the frictional resistance acts as a change of a load upon a driving system which drives the photosensitive drum 20. This results in a change of the circumferential speed of the photosensitive drum 20, and hence, in banding. Meanwhile, in the two-dimensional halftone patterns as those shown in FIGS. 13D through 13H, toner exists continuously from the upstream side (the right-hand side in FIGS. 13D through 13H) to the downstream side (the left-hand side in FIGS. 13D through 13H), and therefore, the photosensitive drum 20 carrying a toner image and the intermediate transfer belt 16 always remain in contact via toner. This means that the frictional resistance does not change in the way described above and a constant load always acts upon the driving system which drives the photosensitive drum 20. As a result, the circumferential speed of the photosensitive drum 20 stabilizes and banding is suppressed.

Third Embodiment

Figure 14A:
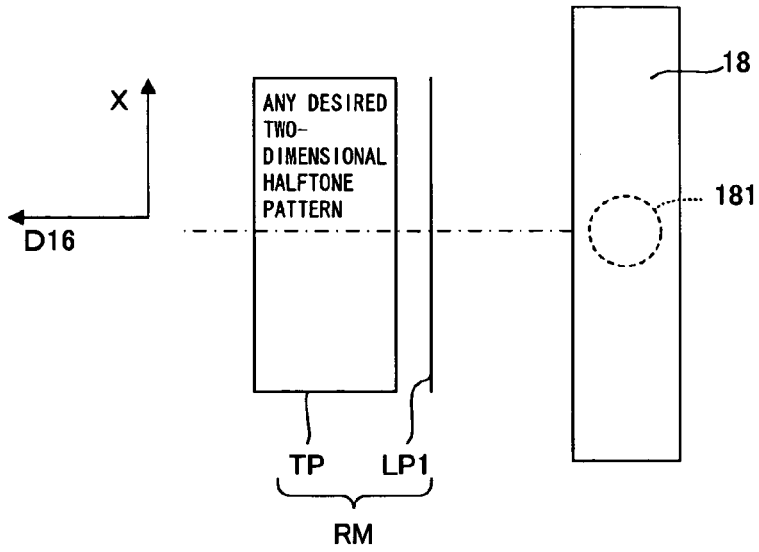
FIG. 14A, FIG. 14B and FIG. 14C are drawings which show operations of the image forming apparatus which is shown in FIG. 1.

Detection of edge portions of registration marks RM realizes detection of the registration marks RM in the second embodiment as described earlier, whereas the third embodiment requires detecting upstream edge portions of registration marks RM taken along the transporting direction D16. That is, a piece of position information regarding each registration mark RM is detected based on a change of the output signal from the test pattern sensor (optical sensor) 18 which occurs as an upstream portion of the registration mark RM along the transporting direction D16 moves passed the test pattern sensor (optical sensor) 18, and the color misregistration correction is executed based on these pieces of position information. Further, as shown in FIG. 14A, a halftone toner image forming each registration mark RM consists of a linear pattern LP1 extending along the main scanning direction X which is approximately orthogonal to the transporting direction D16 and any desired two-dimensional halftone pattern TP, and the linear pattern LP1 is disposed on the upstream side (the right-hand side in FIG. 14A) along the transporting direction D16 such that it is spaced apart from the two-dimensional halftone pattern TP. Since the electric and the optical structures of the image forming apparatus in the second embodiment are identical to those according to the first embodiment, these structures will not be described.

Since registration marks RM have the structure above in the third embodiment, it is possible to detect the position information regarding the registration marks RM at a high accuracy. This enables execution of proper color misregistration correction. The reason is as follows. In the event that a halftone toner image forming a registration mark RM consists only of a two-dimensional halftone pattern TP without using a linear pattern LP1 as that described above, the toner density in edge portions of the registration mark RM locally increases due to the so-called edge effect. Due to this, a change of the environment such as a temperature change intensifies a toner density change particularly in the edge portions. Such changes of the toner density in the edge portions are a major problem against position detection by means of detection of the edge portions of the registration mark RM. On the contrary, in this embodiment, the linear pattern LP1 extending along the main scanning direction X is disposed on the upstream side along the transporting direction D16 relative to the two-dimensional halftone pattern TP such that the linear pattern LP1 is spaced apart from the two-dimensional halftone pattern TP. This suppresses the edge effect which locally increases the toner density in the edge portions of the registration marks RM, and hence, toner density variations in the edge portions attributable to a change of the environment such as a temperature change are suppressed. It is therefore possible to more accurately detect the edge portions of the registration marks RM.

Figure 14B:
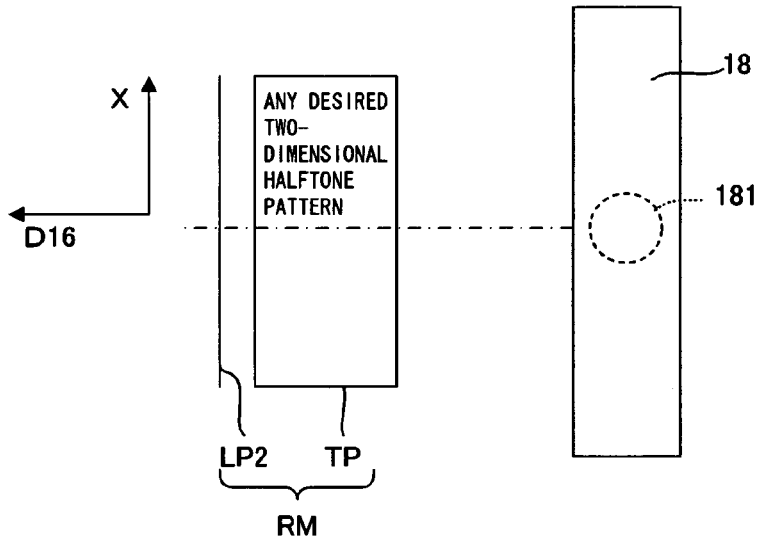
Figure 14C:
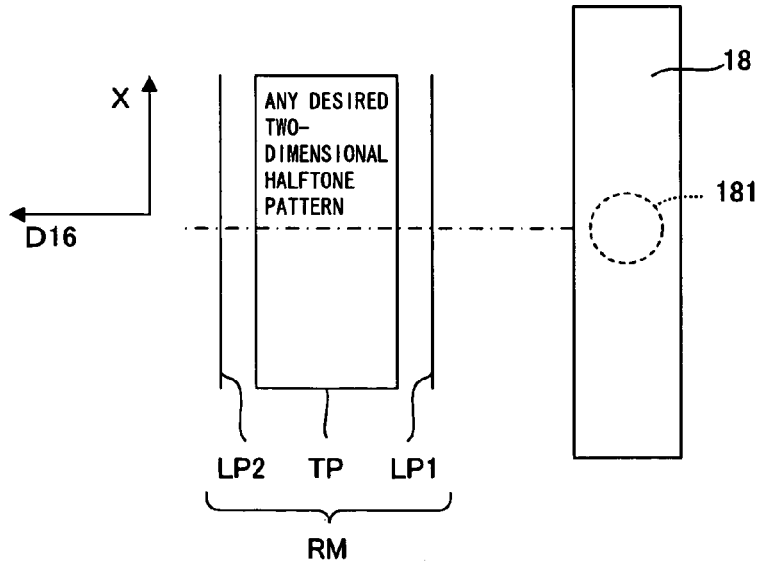

While the third embodiment requires disposing the linear pattern LP1 on the upstream side relative to the two-dimensional halftone pattern TP, an alternative may be to detect the edge portions of the registration marks on the downstream side along the transporting direction D16 and to form a halftone toner image by a linear pattern LP2 extending along the main scanning direction X which is approximately orthogonal to the transporting direction D16 and a two-dimensional halftone pattern TP such that the linear pattern LP2 is spaced apart from the two-dimensional halftone pattern TP toward the downstream side along the transporting direction D16 as shown in FIG. 14B. Further alternatively, a halftone toner image may be formed by a first and a second linear patterns LP1 and LP2, which extend along the main scanning direction X which is approximately orthogonal to the transporting direction D16 of the intermediate transfer belt 18, and a halftone pattern TP such that the first linear pattern LP1, the halftone pattern TP and the second linear pattern LP2 may be spaced apart from each other in this order along the transporting direction D16 as shown in FIG. 14C. It is needless to mention that the halftone pattern shown in FIG. 13 for instance may be used as the two-dimensional halftone pattern TP.

Figure 15:
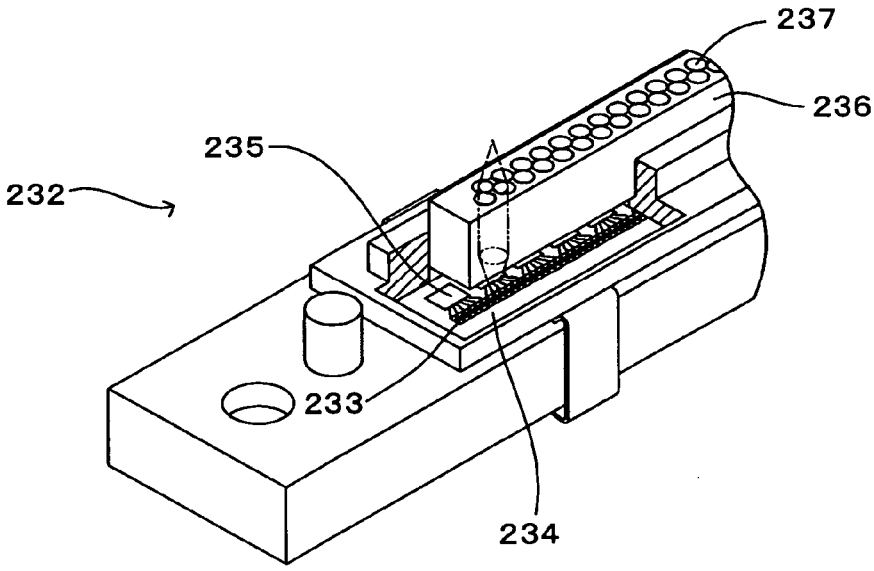
FIG. 15 is a schematic perspective view of an image writer which uses organic EL elements.

The present invention is not limited to the embodiment above, but may be modified in various manners in addition to the preferred embodiments above, to the extent not deviating from the object of the invention. For instance, although the embodiment above uses the image writer which is formed by the array-like write head 232 which is formed by lining up the light emitting diodes 231 in a row as light emitting elements, the light emitting elements may be formed by the organic EL elements. FIG. 15 is a schematic perspective view of an image writer which uses organic EL elements. Detailed portions of a line head in the image writer 23 are shown in FIG. 15. In the write head 232 of each image writer 23, the light emitting array formed by the organic EL elements 233 is held inside a long housing. In the image writer 23, a light emitting part of the light emitting array formed by the organic EL elements 233 is mounted on the glass substrate 234, and TFTs 235 formed on the same glass substrate 234 drive the image writer 23. The refractive index distribution rod lens array 236 forms an imaging optical system, and the refractive index distribution rod lenses 237 are arranged densely in the front face of the light emitting part. The housing covers the area around the glass substrate 234, and the side opposed against the photosensitive drum 20 is open. This realizes emission of a light beam from the refractive index distribution rod lenses 237 toward the photosensitive drum 20. The surfaces of the housing opposed against the edge surfaces of the glass substrate 234 seat optical absorbing members (paint).

Figure 16:
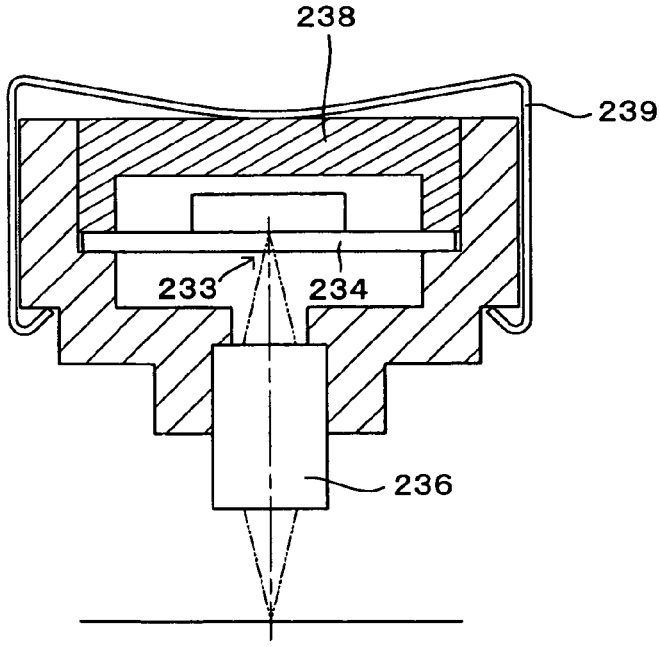
FIG. 16 is a cross sectional view of the image writer taken along the sub scanning direction.

FIG. 16 is a cross sectional view of the image writer 23 taken along the sub scanning direction. The image writer 23 comprises the light emitting array, which is formed by the organic EL elements 233 attached facing the rear surface of the refractive index distribution rod lens array 236 within the housing, and the opaque cover 238 which blocks the light emitting array formed by the organic EL elements 233 from the back surface of the housing. The fixed plate spring 239 presses the cover 238 against the back surface of the housing, thereby sealing up the inside of the housing light-tight. In short, the glass substrate 234 is sealed up light-tight by the fixed plate spring 239. Hence, it is possible to prevent total reflection at the edge surfaces of the glass substrate 234 and efficiently absorb light. There are plural such fixed plate springs 239 at plural locations along the longitudinal direction of the housing.

Alternatively, the write head may include a row-like arrangement of elements such as liquid crystal shutters comprising back lights along the axial direction of the photosensitive drum 20. Of course, an image writer formed by a laser scanning optical system may be used.

Further, the embodiment above is an application of the invention to an image forming apparatus which forms registration marks RM on the intermediate transfer belt 16, the scope of applications of the invention is not limited to this. The invention is generally applicable also to any apparatus which forms registration marks for color misregistration processing on a transfer medium such as an intermediate transfer drum or a transfer sheet.

Fourth Embodiment

In the fourth embodiment, the intermediate transfer belt 16 is made of a belt base material of thermoplastic elastomer alloy whose principal alloy ingredient is thermoplastic elastomer (hereinafter referred to as "TPE"). The main reason is the elasticity. That is, while a PC resin, a PET resin and the like have been often used as the belt base material of the intermediate transfer belt 16, the elasticity is not necessarily sufficient, leaving the problems described earlier. Particularly in the event that a fewer rollers are used to support the intermediate transfer belt 16 or the rollers are smaller, the rollers must bend the intermediate transfer belt 16 deeper and the elasticity accordingly becomes a bigger problem. Noting this, the inventors studied the physical properties of a PC, resin, a PET resin, a PI (polyimide) resin, a PA (polyamide) resin, a TPE alloy as the belt base material of the intermediate transfer belt 16, and found that use of a TPE alloy as the belt base material would realize the intermediate transfer belt 16 which would exhibit excellent elasticity. The fourth embodiment therefore uses the intermediate transfer belt 16 for which a TPE alloy is used as the belt base material.

Figure 17:
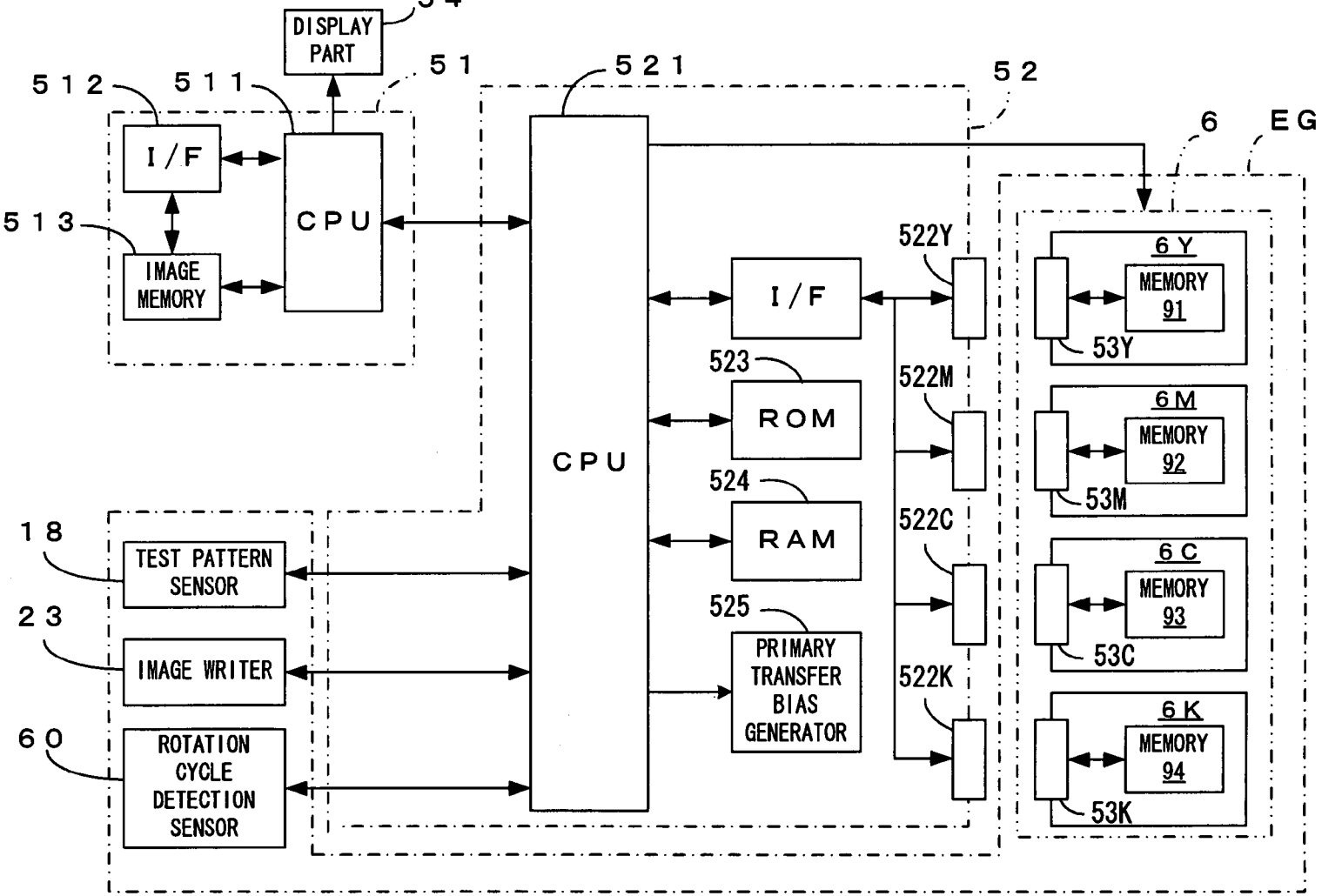
FIG. 17 is a block diagram which shows the electric structure of the image forming apparatus of FIG. 1.

FIG. 17 is a block diagram which shows the electric structure of the image forming apparatus of FIG. 1 according to the fourth embodiment. FIG. 18 is a drawing of a sensor which is disposed near the drive roller. This embodiment uses two types of optical sensors. That is, the test pattern sensor 18 is disposed to the support frame of the transfer belt unit 9, in the vicinity of the drive roller 14. The test pattern sensor 18 is an optical sensor of the so-called reflection type and comprises a light projector (not shown) which irradiates light toward a surface area 181 of an image region (maximum region in which an image is formed) of the intermediate transfer belt 16 and a light receiver (not shown) which receives light reflected by the surface of the intermediate transfer belt 16, registration marks RM, etc. While the light projector irradiates light upon registration marks RM on the intermediate transfer belt 16, the light receiver receives light from the registration marks RM, and the test pattern sensor 18 outputs a signal corresponding the amount of light which the light receiver has received. Toner images on the intermediate transfer belt 16 are aligned to each other based on the output signal from the test pattern sensor 18, the densities of the respective toner images are detected, and a color misregistration, the densities or the like of the respective color images are corrected.

Figure 19:
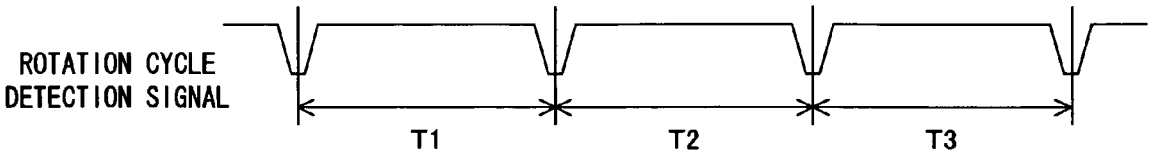
FIG. 19 is a drawing which shows rotation cycle detection signal.

Further, in this embodiment, a rotation cycle detection sensor 60, which detects characteristics sections (which may be rotation cycle detection marks TM for example) of the intermediate transfer belt 16, is attached to the support frame in addition to the test pattern sensor 18. The rotation cycle detection sensor 60 as well is an optical sensor of the so-called reflection type like the test pattern sensor 18. In short, the sensor 60 comprises a light projector (not shown) which irradiates light toward a surface area 601 of a non-image region (region in which an image is not formed) of the intermediate transfer belt 16 and a light receiver (not shown) which receives light reflected by the surface of the intermediate transfer belt 16, rotation cycle detection marks TM, etc. While the light projector irradiates light upon rotation cycle detection marks TM on the intermediate transfer belt 16, the light receiver receives light from the registration marks RM, and the rotation cycle detection sensor 60 outputs a signal corresponding the amount of light which the light receiver has received. That is, a rotation cycle detection signal is output every time a rotation cycle detection mark TM on the intermediate transfer belt 16 passed the sensor 60 as shown in FIG. 19. Hence, measuring the intervals of the rotation cycle detection signal, it is possible to calculate the rotation cycles T (T1, T2, . . . ) of the intermediate transfer belt 16. In this embodiment, the rotation cycle detection sensor 60 thus functions as the "detector which detects rotation cycles of the intermediate transfer belt" of the invention, and for the following reason, it is possible to accurately calculate an internal temperature inside the apparatus 1, namely, the inner-apparatus temperature based on the detection result which the sensor 60 provides. Although this embodiment requires forming rotation cycle detection marks TM and obtaining the rotation cycle detection signal by the so-called reflection method, holes may be bored instead of forming marks TM and the rotation cycle detection signal may be obtained through detection of the holes by the so-called transmission method.

Figure 20:
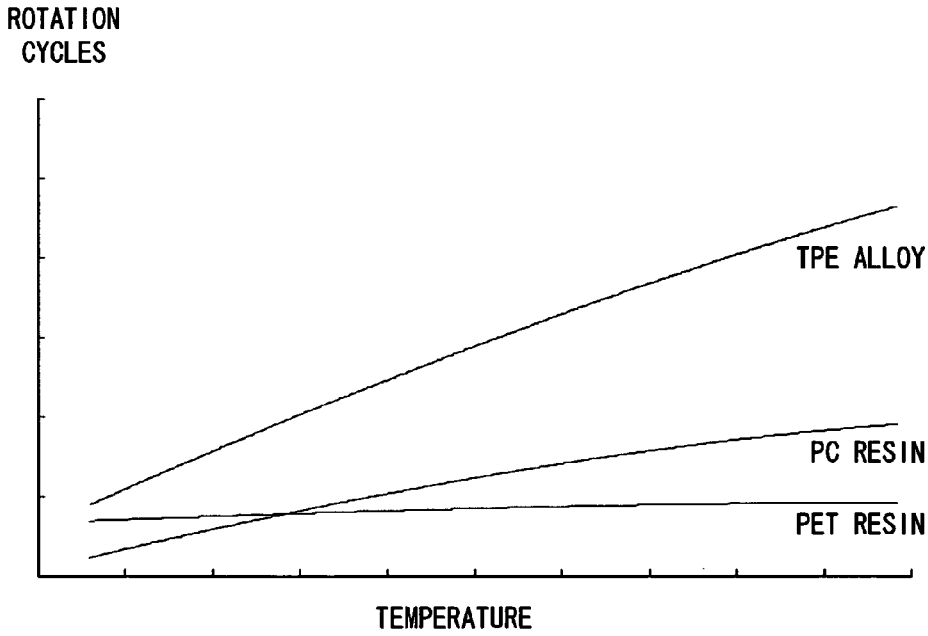
FIG. 20 is a graph of the rotation cycles of an intermediate transfer belt corresponding to a temperature.

FIG. 20 is a graph of the rotation cycles of the intermediate transfer belt corresponding to a temperature. FIG. 20 shows how the rotation cycles T of the intermediate transfer belts 16 for which a PC resin, a PET resin and a TPE alloy are used as the belt base materials change as the temperature changes. As is clear from FIG. 20, when a belt formed by a belt base material of a TPE alloy is used as the intermediate transfer belt 16, the rotation cycles T become longer in accordance with a temperature increase. This is because the coefficient of thermal expansion of TPE is relatively larger than those of a PC resin, a PET resin and the like which have been used as the belt base material and TPE expands and shrinks relatively significantly depending on the inner-apparatus temperature. Where a TPE alloy is used, the amount of expansion and shrinkage of the intermediate transfer belt 16 can serve as an indicator of the inner-apparatus temperature. Noting this, the rotation cycle detection sensor 60 detects the rotation cycles of the intermediate transfer belts 16 and expansion and shrinkage of the intermediate transfer belt 16 is calculated for detection of the inner-apparatus temperature in this embodiment. Operating conditions for the respective portions of the apparatus are controlled based on the detection result as described later.

The image writer 23 uses an array-like write head in which elements such as light emitting diodes and liquid crystal shutters comprising back lights are arranged in a row along the axial direction of the photosensitive drum 20 (the direction perpendicular to the plane of FIG. 1), and is spaced apart from the photosensitive drum 20. The array-like write head is compact, with a shorter optical path than that of a laser scanning optical system. The image writer 23 is advantageous in that it can be disposed in the proximity of the photosensitive drum 20 and that it is therefore possible to reduce the size of the apparatus as a whole.

Further, in this embodiment, the photosensitive drum 20, the charger 22, the developer 24 and the photosensitive drum cleaner 25 of each image forming station Y, M, C or K are put together as a unit which serves as a replacement cartridge 6Y, 6M, 6C or 6K (FIG. 17). The non-volatile memories 91 through 94 are disposed to the replacement cartridges 6Y, 6M, 6C and 6K respectively, for storage of information regarding the replacement cartridges. The transmitters 53Y, 53M, 53C and 53K disposed to the replacement cartridges and the transmitters 522Y, 522M, 522C and 522K disposed to the main section of the apparatus are respectively disposed in the proximity of each other, which enables wireless communication between the CPU 521 of the engine controller 52 and the memories 91 through 94. In this manner, information regarding the respective replacement cartridges is transmitted to the CPU 521 and information inside the memories 91 through 94 is updated.

Figure 21:
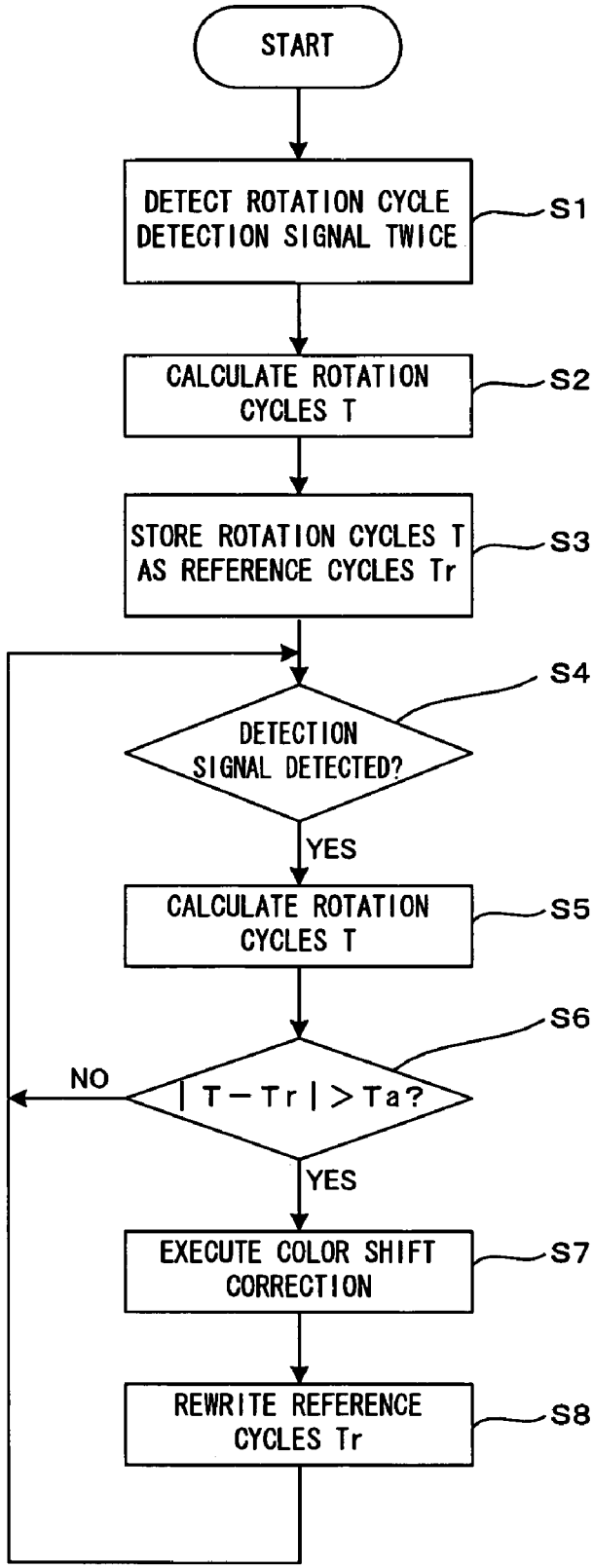
FIG. 21 is a drawing which shows operations of the image forming apparatus which is shown in FIG. 1.

FIG. 21 is a drawing which shows operations of the image forming apparatus which is shown in FIG. 1 according to the fourth embodiment. In this apparatus, the rotation cycle detection sensor 60 detects the rotation cycles of the intermediate transfer belt 16 and the timing of executing the color misregistration correction is controlled based on the detection result as shown in FIG. 21. To be more specific, in accordance with a program stored in the ROM 523 regarding the color misregistration correction, the CPU 521 of the engine controller 52 controls the respective portions of the apparatus in the following manner, whereby the timing of executing the color misregistration correction is adjusted.

As the rotation cycle detection sensor 60 outputs the rotation cycle detection signal twice at Step S1, an internal timer (not shown) counts the time from the first outputting of the rotation cycle detection signal to the next outputting of the signal, thereby calculating the time in which the intermediate transfer belt 16 rotates one round, that is, the rotation cycles T (Step S2). The rotation cycles T are then stored in the RAM 524 as reference cycles Tr (Step S3). This completes preparation for detection of a change of the inner-apparatus temperature.

For every outputting of the rotation cycle detection signal (Step S4), the internal timer counts the elapsed time since the previous rotation cycle detection signal and the rotation cycles T are calculated (Step S5). Further, the absolute value $|T-Tr|$ of the difference between the rotation cycles T and the reference cycles Tr is compared against a tolerance Ta which has been set in advance (Step S6). In short, the absolute value $|T-Tr|$ is indicative of the amount of changes of the rotation cycles and serves as an indicator of a change of the inner-apparatus temperature. Noting this, this embodiment requires determining at Step S6 whether the inner-apparatus temperature has changed beyond the tolerance Ta.

When it is determined "NO" at Step S6, that is, when it is determined that the amount of changes of the rotation cycles is small and a change of the inner-apparatus temperature is small, the sequence returns back to Step S4, thereby repeating detection of the next rotation cycle detection signal and calculation of the rotation cycles T. On the contrary, when it is determined "YES" at Step S6, that is, when it is determined that the amount of changes of the rotation cycles is over the tolerance Ta and a change of the inner-apparatus temperature is large, the color misregistration correction is carried out since it is likely that the speed of the intermediate transfer belt 16 has changed and the respective portions of the apparatus have expanded or shrank (Step S7).

During the color misregistration correction, for instance, the image forming stations Y, M, C and K form registration marks RM, which are shaped like stripes extending parallel along the main scanning direction X which is orthogonal to the transporting direction D16 of the intermediate transfer belt 16, in the image region of the intermediate transfer belt 16 such that the registration marks RM are spaced apart from each other by a predetermined gap (which may be 0.5 mm for instance) along the transporting direction (sub scanning direction or moving direction) D16 in the order of K, C, M and Y as shown in FIG. 18. Although FIG. 18 shows only the yellow registration mark RM(Y), the black registration mark RM(K), the cyan registration mark RM(C) and the magenta registration mark RM(M) and the yellow registration mark RM(Y), plural registration marks are formed for each color. The registration marks RM(K), RM(C), RM(M) and RM(Y) formed on the intermediate transfer belt 16 in the manner above move along the transporting direction D16 as the intermediate transfer belt 16 moves, and further passed the detection area 181 of the test pattern sensor 18. At this stage, the voltage level of the signal output from the test pattern sensor 18 changes in accordance with the amount of the received light. Hence, measurement of the voltage level makes it possible to measure the timing at which each registration mark RM passed the test pattern sensor 18 and acquire position information regarding the registration marks RM. As the position information regarding all registration marks RM is obtained, the color misregistration correction is carried out based on the position information.

After rewriting the reference cycles Tr stored in the RAM 524 into the rotation cycles T calculated at Step S5 in parallel to or following the color misregistration correction (Step S8), the sequence returns back to Step S4, thereby repeating the series of operations described above (Step S4 through Step S8).

As described above, this embodiment which uses a TPE alloy as the belt base material of the intermediate transfer belt 16 dramatically improves the elasticity beyond those of intermediate transfer belts made of a PC resin, a PET resin and the like, and achieves formation of images having an excellent quality while preventing defective transfer of toner images.

Further, this embodiment requires control of the timing of executing the color misregistration correction, noting that the amount of expansion and shrinkage of the intermediate transfer belt 16 can serve as an indicator of the internal temperature inside the apparatus when the belt base material of the intermediate transfer belt 16 is a TPE alloy. In other words, rotation cycle detection marks TM are formed in the non-image region of the intermediate transfer belt 16 and the rotation cycle detection sensor 60 for detection of the marks TM is disposed. The rotation cycles of the intermediate transfer belt 16 are calculated based on the rotation cycle detection signal detected by the sensor 60, the difference from the reference cycles Tr ($|T-Tr|$) is calculated, and a change of the inner-apparatus temperature is calculated, which attains accurate calculation of the change of the inner-apparatus temperature.

This is because the intermediate transfer belt 16 rotates in the predetermined direction while carrying toner images and its expansion and shrinkage reflect an average temperature inside the apparatus.

When a change of the inner-apparatus temperature is beyond the tolerance, the color misregistration correction is executed in this embodiment. Since the color misregistration correction is carried out appropriately at such timing which would otherwise see occurrence of a color misregistration as a result of a change of the speed of the intermediate transfer belt 16, expansion and shrinkage of the respective portions of the apparatus and the like caused by the change of the inner-apparatus temperature, it is possible to prevent a color misregistration, deteriorated hues, etc.

Figure 22:
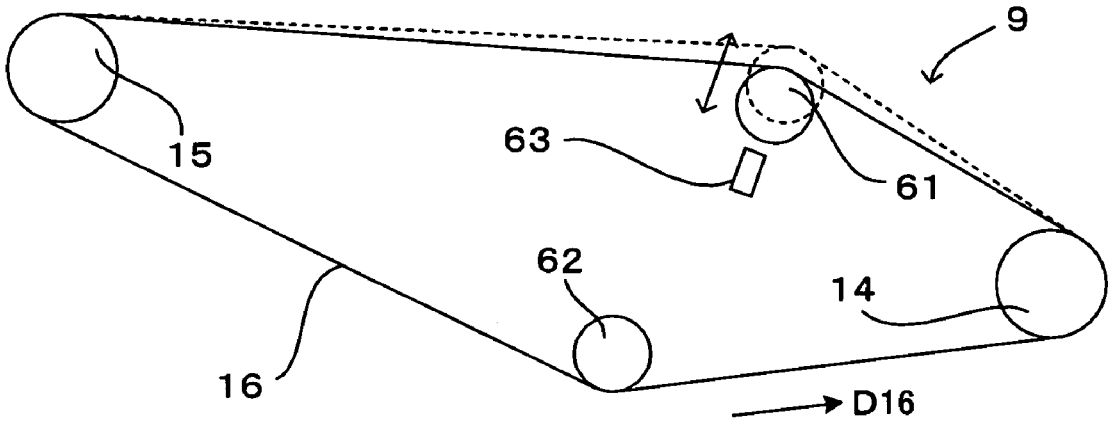
FIG. 22 is a drawing which shows action of a tension roller.
Figure 23:
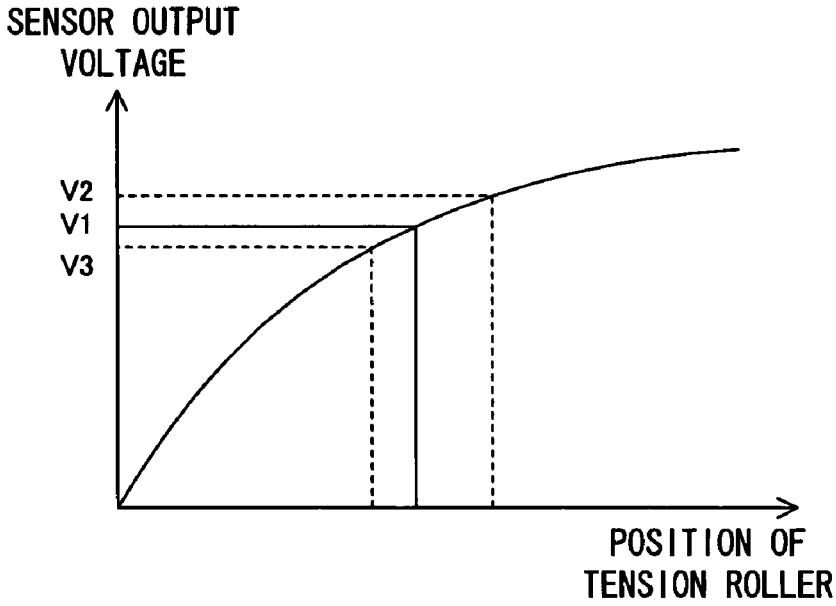
FIG. 23 is a drawing which shows voltage out put from a position sensor.

By the way, where the belt base material of the intermediate transfer belt 16 is a TPE alloy, the intermediate transfer belt 16 expands or shrinks by a relatively amount due to a change of the inner-apparatus temperature. Hence, it is desirable as shown in FIG. 22 to dispose a tension roller 61 in addition to the fix rollers 14 and 15 to apply predetermined tension upon the intermediate transfer belt 16. In other words, the transfer belt unit 9 may have such a structure that the intermediate transfer belt 16 is spun around the drive roller 14, the follower rollers 15 and 62 and the tension roller 61 and rotates along the arrow direction D16 as shown in FIG. 22. The apparatus having this structure as well is capable of calculating a change of the inner-apparatus temperature, as the rotation cycles of the intermediate transfer belt 16 are calculated based on the rotation cycle detection signal detected by the rotation cycle detection sensor 60, as in the embodiments above. In addition, a position sensor 63 may be disposed near the tension roller 61 and a change of the inner-apparatus temperature may be calculated depending upon the position of the tension roller 61 detected by the position sensor 63 as shown in FIG. 22. This is because as the intermediate transfer belt 16 expands or shrinks due to a change of the inner-apparatus temperature, the tension roller 61 moves in accordance with the amount of expansion or shrinkage and the value of a voltage output from the position sensor 63 changes as shown in FIG. 23. In light of this, a change of the inner-apparatus temperature may be detected based on the output signal from the position sensor 63 instead of the rotation cycle detection signal and the timing of executing the color misregistration correction may be controlled. That is, the position sensor 63 may function as the "detector which detects position of the tension roller" of the invention. This will now be described in detail with reference to FIG. 24.

Fifth Embodiment

Figure 24:
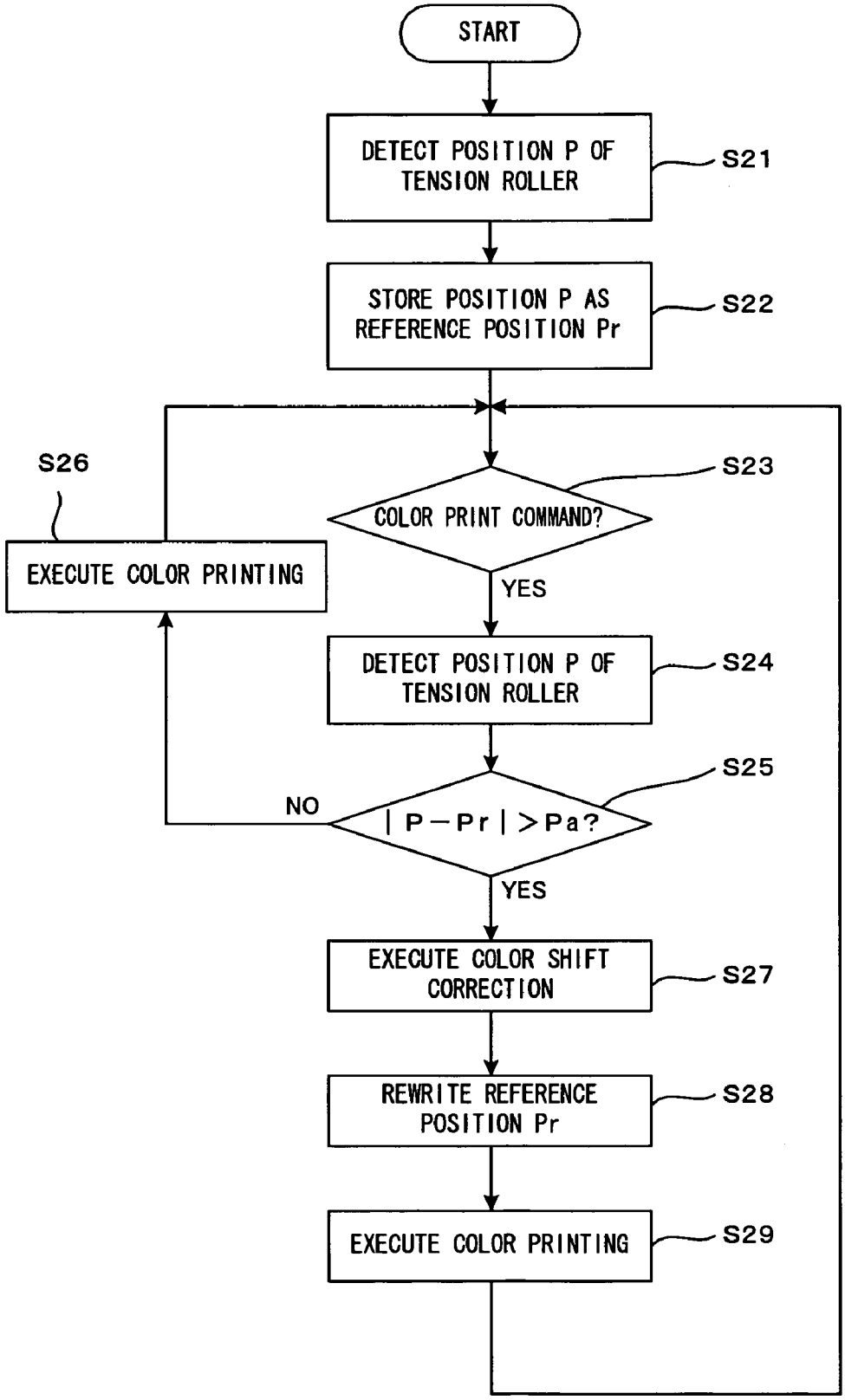
FIG. 24 is a flow chart which shows operations of the image forming apparatus which is shown in FIG. 1.

FIG. 24 is a flow chart which shows operations of the image forming apparatus which is shown in FIG. 1 according to the fifth embodiment. In this apparatus, as shown in FIG. 24, the position sensor 63 detects the position of the tension roller 61 and the timing of executing the color misregistration correction is controlled based on the detection result. To be more specific, in accordance with a program stored in the ROM 523 regarding the color misregistration correction, the CPU 521 of the engine controller 52 controls the respective portions of the apparatus in the following manner, whereby the color misregistration correction is executed.

The position P of the tension roller 61 is detected based on the output signal from the position sensor 63 at Step S21. The detection result (the position P of the tension roller 61) is stored as a reference position Pr in the RAM 524 (Step S22). This completes preparation for detection of a change of the inner-apparatus temperature.

For every color print command (Step S23), the position P of the tension roller 61 is detected based on the output signal from the position sensor 63 (Step S24). Further, the absolute value |P−Pr| of the difference between the position P and the reference position Pr is compared against a tolerance Pa which has been set in advance (Step S25). In short, the absolute value |P−Pr| is indicative of the amount of a change of the tension roller 61 and serves as an indicator of a change of the inner-apparatus temperature. Noting this, this embodiment requires determining at Step S25 whether the inner-apparatus temperature has changed beyond the tolerance Pa.

When it is determined "NO" at Step S25, that is, when it is determined that the amount of changes of the rotation cycles is small and a change of the inner-apparatus temperature is small, after color printing without the color misregistration correction (Step S26), the sequence returns back to Step S23 and waits for the next color print command. On the contrary, when it is determined "YES" at Step S25, that is, when it is determined that the tension roller 61 has changed beyond the tolerance Pa and a change of the inner-apparatus temperature is large, the color misregistration correction is carried out as in the embodiments above since it is likely that the speed of the intermediate transfer belt 16 has changed and the respective portions of the apparatus have expanded or shrank (Step S27).

The reference position Pr stored in the RAM 524 is written into the position P of the tension roller 61 detected at Step S24 in parallel to or following the color misregistration correction (Step S28). After execution of color printing following the completion of the color misregistration correction (Step S29), the sequence returns back to Step S23 and waits for the next color print command.

Although utilizing the position of the tension roller 61 as an indicator of a change of the inner-apparatus temperature as described above, this embodiment is otherwise similar to the earlier embodiments and attains similar effects. That is, use of a TPE alloy as the belt base material of the intermediate transfer belt 16 makes it possible to improve the elasticity, prevent defective transfer of toner images and form images in an excellent quality. Further, the position of the tension roller 61 which moves in accordance with expansion or shrinkage of the intermediate transfer belt 16 is detected, the difference against the reference position Pr (|P−Pr|) is calculated and a change of the inner-apparatus temperature is calculated, which attains accurate calculation of the change of the inner-apparatus temperature. Execution of the color misregistration correction upon a change of the inner-apparatus temperature beyond the tolerance prevents a color misregistration, deteriorated hues, etc.

The present invention is not limited to the embodiment above, but may be modified in various manners in addition to the preferred embodiments above, to the extent not deviating from the object of the invention. For instance, although a change of the inner-apparatus temperature is detected from the rotation cycles of the intermediate transfer belt 16, the position of the tension roller 61 and the like and the timing of executing the color misregistration correction is controlled in the embodiments above, the control may be exercised at other processing timing. This is because an adverse influence of a changed inner-apparatus temperature over the image quality is not limited to a color misregistration but may include for example changed optimal values of operating conditions (the developing bias, the exposure energy, the charging bias, etc.) under which the image forming stations Y, M, C and K must form toner images. When the operating conditions for the image forming stations Y, M, C and K deviate from the optimal values, the densities of toner images change from desired values and the image quality deteriorates. The timing of executing optimization processing, which optimizes the operating conditions, may therefore be controlled based on the rotation cycles of the intermediate transfer belt 16, the position of the tension roller 61 or the like, which assures formation of toner images always under favorable operating conditions and enhances the image quality. The "optimization processing" is processing during which toner images are formed as patch images while changing the operating conditions for the image forming stations Y, M, C and K, the densities of the patch images are detected and the operating conditions are optimized. Toner image transfer conditions as well are susceptible to the inner-apparatus temperature, and therefore, it is desirable to control the transfer conditions based on the rotation cycles of the intermediate transfer belt 16, the position of the tension roller 61 or the like as in the color misregistration correction and the optimization processing.

Further, the embodiments above require detecting a change of the inner-apparatus temperature based on the rotation cycles of the intermediate transfer belt 16, the position of the tension roller 61 and the like. However a table, a function or the like expressing the inner-apparatus temperature which corresponds to the rotation cycles, the position of the tension roller and the like may be prepared and stored in the ROM 523 in advance, and the inner-apparatus temperature itself may be identified from the table, the function or the like upon detection of the rotation cycles, the position of the tension roller or the like. In short, where such a table, a function or the like is prepared, expansion and shrinkage of the intermediate transfer belt 16 can function as a temperature sensor for the inner-apparatus temperature.

While the embodiments above are applications of the invention to image forming apparatuses of the so-called tandem type, the scope of applications of the invention is not limited to this. The invention is generally applicable also to any apparatus in which toner images formed by an image former are transferred onto an intermediate transfer belt which rotates and the toner images are temporarily carried.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a transfer medium which moves in a predetermined moving direction;

a plurality of image forming stations, arranged along the moving direction, which form toner images of mutually different colors as registration marks on a surface of the transfer medium such that the toner images are spaced apart from each other along the moving direction;

an optical sensor which detects each of the plural registration marks and outputs a signal; and a controller which corrects a color misregistration between/among the plural colors based on the output signal from the optical sensor, wherein each of the plural registration marks is formed by a two-dimensional pattern and a linear pattern which extends along a main scanning direction which is approximately orthogonal to the moving direction, and wherein the linear pattern and the two-dimensional pattern are spaced apart from each other along the moving direction.

2. An image forming apparatus according to claim 1, the controller obtains position information regarding each of the plural registration marks based on a change of the output signal which occurs when an upstream portion of each of the plural registration marks passed the optical sensor along the moving direction, and corrects the color misregistration based on the position information, and wherein each of the plural image forming stations forms the linear pattern spaced apart toward an upstream side along the moving direction from the two-dimensional pattern.

3. An image forming apparatus according to claim 1, the controller obtains position information regarding each of plural registration marks based on a change of the output signal which occurs when a downstream portion of each of the plural registration marks passed the optical sensor along the moving direction, and corrects the color misregistration based on the position information, and wherein each of the plural image forming stations forms the linear pattern spaced apart toward a downstream side along the moving direction from the two-dimensional pattern.

4. An image forming apparatus comprising:

a transfer medium which moves in a predetermined moving direction;

a plurality of image forming stations, arranged along the moving direction, which form toner images of mutually different colors as registration marks on a surface of the transfer medium such that the toner images are spaced apart from each other along the moving direction;

an optical sensor which detects each of the plural registration marks and outputs a signal; and a controller which corrects a color misregistration between/among the plural colors based on the output signal from the optical sensor, wherein each of the plural registration marks is formed by a two-dimensional pattern and a first and a second linear patterns which extend along a main scanning direction which is approximately orthogonal to the moving direction, and wherein the first linear pattern, the two-dimensional pattern and the second linear pattern are placed in the order named in the moving direction, and are spaced apart from each other along the moving direction.

5. An image forming apparatus comprising:

a transfer medium which moves in a predetermined moving direction;

a plurality of image forming stations, arranged along the moving direction, which form toner images of mutually different colors as registration marks on a surface of the transfer medium such that the toner images are spaced apart from each other along the moving direction;

an optical sensor which detects each of the plural registration marks and outputs a signal; and a controller which corrects a color misregistration between/among the plural colors based on the output signal from the optical sensor, wherein each of the plural registration marks is a halftone toner image.

6. An image forming apparatus according to claim 5, wherein the halftone toner image has a two-dimensional halftone pattern.

7. An image forming apparatus according to claim 6, wherein the two-dimensional halftone pattern is a pattern having plural transverse lines which extend approximately parallel to the moving direction and are placed from the upstream side to the downstream side of the two-dimensional halftone pattern along the moving direction.

8. An image forming apparatus according to claim 6, wherein the two-dimensional halftone pattern is a pattern having plural inclined lines which extend diagonally with respect to the moving direction and are placed from the upstream side to the downstream side of the two-dimensional halftone pattern along the moving direction.

9. An image forming apparatus according to claim 6, wherein the two-dimensional halftone pattern is a grid-like patterns.

10. An image forming apparatus according to claim 5, wherein the controller obtains position information regarding each of the plural registration marks based on a change of the output signal which occurs when an upstream portion of each of the plural registration marks passed the optical sensor along the moving direction, and corrects the color misregistration based on the position information, wherein the halftone toner image is formed by a linear pattern and a two-dimensional halftone pattern, the linear pattern extending along a main scanning direction, which is approximately orthogonal to the moving direction, and being spaced apart toward an upstream side along the moving direction from the two-dimensional pattern.

11. An image forming apparatus according to claim 5, wherein the controller obtains position information regarding each of the plural registration marks based on a change of the output signal which occurs when a downstream portion of each of the plural registration marks passed the optical sensor along the moving direction, and corrects the color misregistration based on the position information, wherein the halftone toner image is formed by a linear pattern and a two-dimensional halftone pattern, the linear pattern extending along a main scanning direction, which is approximately orthogonal to the moving direction, and being spaced apart toward a downstream side along the moving direction from the two-dimensional halftone pattern.

12. An image forming apparatus according to claim 5, wherein the halftone toner image is formed by a first and a second linear patterns, which extend along a main scanning direction which is approximately orthogonal to the moving direction, and a halftone pattern, and wherein the first linear pattern, the halftone pattern and the second linear patterns are placed in the order named in the moving direction, and are spaced apart from each other along the moving direction.

* * * * *